US006546106B2

(12) United States Patent
Azima

(10) Patent No.: US 6,546,106 B2
(45) Date of Patent: Apr. 8, 2003

(54) ACOUSTIC DEVICE

(75) Inventor: Henry Azima, Cambridge (GB)

(73) Assignee: New Transducers Limited, London (GB)

( * ) Notice: Subject to any disclaimer, the term of this patent is extended or adjusted under 35 U.S.C. 154(b) by 0 days.

(21) Appl. No.: 09/280,854

(22) Filed: Mar. 30, 1999

(65) Prior Publication Data

US 2003/0007654 A1 Jan. 9, 2003

Related U.S. Application Data

(63) Continuation-in-part of application No. 08/707,012, filed on Sep. 3, 1996, now Pat. No. 6,332,029.

(30) Foreign Application Priority Data

Apr. 2, 1998 (GB) ..... 9806994

(51) Int. Cl.[7] ..... H04R 25/00
(52) U.S. Cl. ..... 381/152; 381/388; 381/423
(58) Field of Search ..... 381/87, 152, 162, 381/182, 332–333, 374, 386–388, 398, 423, 431, FOR 151, FOR 153, FOR 162, FOR 163, FOR 165; 181/142–143, 150, 157, 199

(56) References Cited

U.S. PATENT DOCUMENTS

| | | | | |
|---|---|---|---|---|
| 1,500,331 A | | 7/1924 | Marriott | |
| 3,247,925 A | * | 4/1966 | Warnaka | |
| 3,347,335 A | | 10/1967 | Watters et al. | 181/5 |
| 3,596,733 A | | 8/1971 | Bertagni | 181/32 |
| 6,058,196 A | * | 5/2000 | Heron | 381/152 |

FOREIGN PATENT DOCUMENTS

| | | |
|---|---|---|
| EP | 0 924 960 | 6/1999 |
| WO | WO 92/03024 | 2/1992 |
| WO | WO 97/09842 | 3/1997 |
| WO | WO 98/00621 | 1/1998 |

* cited by examiner

*Primary Examiner*—Curtis Kuntz
*Assistant Examiner*—P. Dabney
(74) *Attorney, Agent, or Firm*—Foley & Lardner

(57) ABSTRACT

Acoustic device comprising a member relying on bending wave action with beneficial distribution of resonant modes thereof, wherein the member has its acoustically active area at least partly bounded by means having a substantially restraining nature in relation to bending wave vibration. Operation can be below coincidence, or above if desired for active acoustic device further having beneficial location of bending wave transducer means determined with reference to and taking account of such bounding means.

27 Claims, 21 Drawing Sheets

FIG. 3
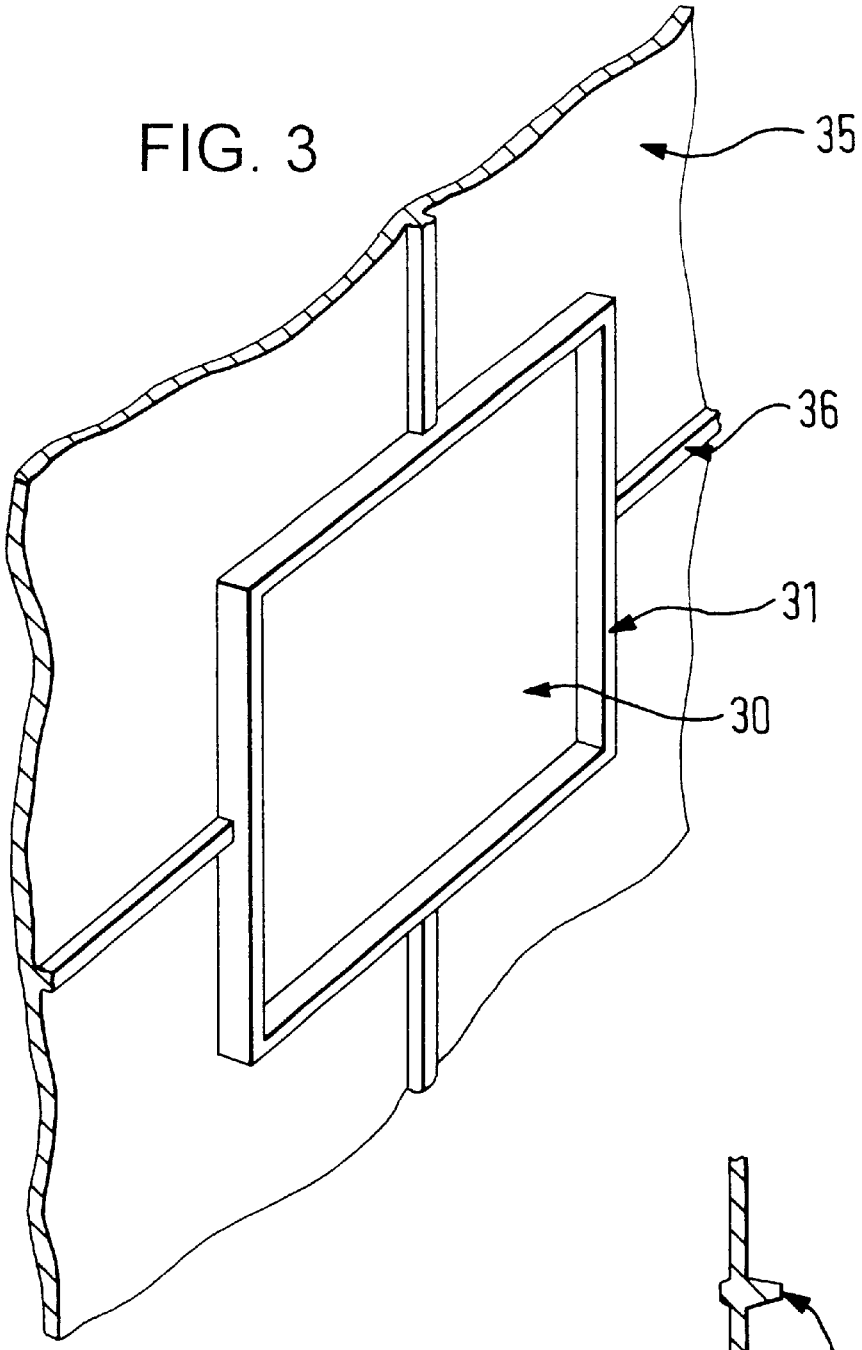
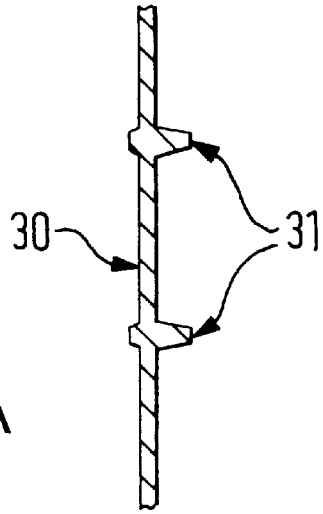
FIG. 3A $\zeta = 10 \cdot \%$ $\xi 0 = 0.437$ $\eta 0 = 0.414$ $\zeta = 10 \cdot \%$ $\xi 0 = 0.409$ $\eta 0 = 0.439$

ACOUSTIC DEVICE

This application is a continuation-in-part of application Ser. No. 08/707,012, filed Sep. 3, 1996 (now U.S. Pat. No. 6,332,029).

FIELD OF INVENTION

The invention relates to acoustic devices of the kind comprising a sound radiating member relying on bending wave action and resulting surface vibration to produce acoustic output.

BACKGROUND TO INVENTION

It is known from U.S. Pat. No. 3,247,925 of WARNAKA to suggest a low frequency loudspeaker consisting of an extremely rigid resonant panel, the peripheral edges of which are bolted or cemented to a rigid frame, which frame supports a conventional voice coil transducer which imparts bending wave energy to the centre of the panel. This low frequency loudspeaker device is said to operate entirely above wave coincidence frequency.

It is also known from U.S. Pat. No. 3,596,733 of BERTAGNI to propose a loudspeaker having a diaphragm formed by an expanded polystyrene plate-like member having a pre-tensioned front face and a rear face of or including an irregular shape.

Revelatory teaching concerning bending wave action acoustic devices, conveniently considered as generally of resonant panel type, is given in International Patent Application W097/09842, including as to improvement or optimisation of acoustic performance according to panel parameters including geometry and bending stiffness; particularly including operation usefully at and below coincidence frequency. Geometrical parameters of interest include proportions or aspect ratios of panels as such, including for use as passive acoustic devices. Parameters of bending stiffness(es) can usefully interact with geometric parameters, including anisotropy thereof, say as to different bending stiffnesses of or resolvable to substantial constancy along axes of geometric shapes involved for viable variation of proportions of such shapes. Preferential in-board locations for transducers of active acoustic devices usefully have proportional defining coordinates. Other areal distributions of bending stiffness can usefully contribute to affording other useful locations for transducers, for example substantially at geometric centres and/or at centres of mass, see International Patent Application WO98/00621 including for combining aforesaid bending wave action with further acoustically relevant pistonic action. Acoustic operation is described and claimed in at least W097/09842 for both of whole panels and only parts thereof being acoustically active.

On an intuitive basis, our specific analysis and design methodology to date for such resonant mode bending wave action acoustic devices has been mainly concentrated upon whole panels where edges are wholly or substantially free to vibrate when in acoustically relevant desired bending wave action, including where subject to light edge damping. This invention arises from surprising results of counter-intuitive further consideration, research and experimentation.

SUMMARY OF THE INVENTION

Certain under-lying requirements continue to apply and be of profound technological/inventive significance, specifically for an acoustic device member extending transversely of its thickness and capable of sustaining bending waves through its consequentially acoustically active area, i.e. basic requirement for what is herein called a resonant acoustic member or panel; and for parameters such as geometric and for bending stiffness to be of values consonant with resulting distribution of natural bending wave vibration of said member that is effective in or beneficial to achieving desired or acceptable acoustic operation of the device over a frequency range of interest, i.e. further requirement for a resonant acoustic member or panel hereof. Specific embodiments of this invention additionally provide for means affording substantial restraint of bending wave vibration typically at edge, periphery or other boundary of such member or panel or acoustically active area thereof, and further typically to be at least capable of operating at least partly below coincidence frequency. The wording 'substantial restraint' as used herein intentionally involves greater constraining of at least part(s) of edge(s) of the member than specifically disclosed in W097/09842, preferably as to both of edge extent(s) and effective loading, grip or effective grounding effect.

There are two views, effects or inventive aspects that it is seen as useful to consider relative to such substantial edge/areally bounding/peripheral restraint.

One is that limitation/reduction of available bending wave vibrational edge/peripheral/boundary movement of the member (compared with specific disclosure of WO97/09842) can produce useful compounding of achieved acoustic output from vibrational bending wave energy back in the acoustically active area. The other is that the acoustically relevant and effective natural modes of resonant bending wave action will be different (compared with specific disclosure of WO97/09842) by reason of limiting/suppressing bending wave vibration movement at edge(s)/periphery/boundary of the member, thus effectively reducing/eliminating contributions(s) from lowest resonant mode(s) that would be active if edge(s)/periphery/boundary of the acoustically effective area of the member were as free to have bending wave distribution as specifically disclosed in WO97/09842; and reduction/substantial suppression of resonant modes involving twisting.

Resulting nominally less populous or less rich content of acoustically active/relevant resonant bending wave modes can be exemplified for simplified analogy and analysis based on equivalent simple beams with account taken of interactions, in terms of involving resonant plate modes that relative to each beam start at resonant mode frequency f1 rather than f0, and further 'losing' combinational modes involving f0 frequencies, but with interesting and useful effects available with respect to even-ness of spacings of directly and combinationally related natural resonant modes involving f1 frequencies.

Ramifications are extensive and can be advantageous, including attainability of improved acoustic efficiency of energy conversion and/or often very usefully increased extents of candidate sub-areas for viable/optimal transducer location(s), at least as identified by mechanical impedance analysis as taught in co-pending International patent application PCT/GB99/00404; and/or typically much greater range of viability of areal shapes/proportions of said members as exemplified for isotropic bending stiffness, even at about 1:1 through to about 1:3 and more for aspect ratio(s); and/or viability of acoustic performance for panel member materials of lower intrinsic bending stiffness at least as effectively stiffened overall by contribution from edge(s)/peripheral/boundary restraint hereof; and/or capabilities in relation to high power input transducer means for loudspeaker embodiments, all including where such restraint can afford substantial loading whether on an inertial grounding basis or as is further practical by actual fixing in a more rigid/massive carrier or other heavy loading manner.

It is a significant advantage of this invention that novel and useful resonant panel acoustic devices are provided, including active acoustic devices as loudspeakers, with significant facilitation of manufacture as robust readily-mounted panel-type devices, particularly enhanced relative to acoustic devices specifically illustrated and described in International Patent Application W097/09842.

According to one aspect of the present invention there is provided an acoustic device relying on bending wave action and capable of operating below coincidence, comprising a member affording said acoustic operation by reason of beneficial distribution of resonant modes of bending wave action therein, wherein the member has its acoustically active area at least partly bounded by means having a substantially restraining nature in relation to bending wave vibration.

According to another aspect of the present invention there is provided an active acoustic device comprising a member relying on bending wave action with beneficial distribution of resonant modes thereof and beneficial location of bending wave transducer means, wherein the member has its acoustically active area at least partly bounded by means having a substantially restraining nature in relation to bending wave vibration, and its transducer means location determined with reference to and taking account of such bounding means.

The entire periphery of an acoustic member hereof may be substantially restrained, or clamped; or only part(s) less than all of periphery of the member, e.g. a rectangular panel, may be restrained or clamped at one or more up to all of its side edges. This can be useful as a flag-like mounting affording said substantial restraint at one side with the acoustically active area protruding therefrom, or as mounting at two sides that may be parallel and afford said substantial restraint with the acoustically active area between those mounting and restraining sides; and can facilitate the manufacture of up to fully sealed or only highly selectively vented diaphragm loudspeakers, e.g. mid/high frequency devices. A fully or near-fully sealed diaphragm enables the making of a so-called infinite baffle loudspeaker to contain/control rear acoustic radiation which might otherwise be detrimental at mid to low frequencies.

Full substantially restraining or clamping frames also enable design of the loudspeaker assembly to be more predictable in mechanical terms, along with facilitating making a loudspeaker assembly which is relatively robust in construction (compared to a resonant panel loudspeaker in which the panel edges are substantially free or are suspended in an only lightly damping resilient manner).

Substantial restraint or clamping of peripheral portion(s) or edge(s) of the acoustic member may be achieved in any desired manner, e.g. by intimately fixing the edge(s) to a strong frame or the like by means of an adhesive, or by mechanical means say involving clamping the edge(s) between frame members. The desired edge restraint/clamping hereof may also be achieved by moulding techniques (such as injection moulding of plastics materials) by forming the edges of the member with integral or integrated thickened surround portions of sufficient rigidity to terminate edge movement of the acoustic member. Co-moulding of the acoustic member and thickened edge provision may be appropriate. Such moulding techniques may be particularly suitable where the acoustic member is formed as a monolith and may be readily achievable in economic manner.

Substantial restraint or clamping may also be used to define one acoustic member within another larger acoustic member. Thus a large acoustic panel intended for mid/low frequency operation may be moulded to include a smaller acoustic panel intended for high frequency operation and defined by medial stiffening ribs.

Substantial restraint or clamping action can be designed to present a mechanical termination impedance designed to control the reverberation time within the acoustic member as an aid to control of the frequency response of the member, perhaps especially at lower frequencies.

Proportions of suitable resonant panel members may be as or substantially different from specific teaching of WO97/09842 regarding variations on particular shapes. For example, substantially rectangular resonant panel members of substantially isotropic bending stiffness could be of aspect ratios below 1:1.5 then generally inclusive of prior teaching for substantially free edge panel members but not limited thereto as will be specifically described later herein, or greater than 1:1.5 as will also be specifically described later herein. Variations for anisotropy/complex distribution of bending stiffness(es) is envisaged as above.

The bounding means may be at least partially about and definitive of said acoustically active area and/or about peripheral edge(s) of a panel-form member to be wholly acoustically active, typically to extent of up to 25% or more of full area boundary/peripheral edge extent, often the whole thereof.

Resonant panel members are generally self-supporting and would not require pre-tensioning for mechanical stability, particularly for types typical of free edge or simple edge supported use.

For clamped panel member there is a ten-fold or thereabouts increase in first bending frequency due to the natural stiffening of the panel member when clamped. It is logical and sensible to substantially reduce the bending stiffness property to reduce the first modal frequency and before the lower frequency range. It is envisaged that the stiffness of panel member in such cases may be as low as 0.001 Nm and the area density as small as 25 $g/m^2$.

From one viewpoint these ends of range values describe a panel member which for mechanical stability and the function for drive means support may benefit from the application of tensioning forces. These may be applied uniformly or differentially, i.e. in different directions and/or at different tensions, with respect to the effective geometry of the member.

At the limit the tensioned panel exhibits a high proportion of the properties of a tensioned film supporting bending waves and with predominantly second order or non-dispersive wave action (velocity constant with frequency). For such a 'panel' member the resonant distribution may be optimised for desired acoustic behaviour by control of tensioning and boundary geometry in broad agreement with distributed mode teaching, see WO97/09842. Likewise a preferred modal distribution may be further augmented into action as a transducer via preferred/optimised placement of the exciter/sensor.

Depending on the degree of tensioning and with increasing density and more particularly bending stiffness, there will be a range where second order bending wave action is superimposed and augmented by fourth order, dispersive bending action-due to stiffness. Optimisations of the two may be derived by calculation and/or experiment to provide the best results in a given application.

Smaller wide-bandwidth acoustic panels with edge clamping are the envisaged field of design.

BRIEF DESCRIPTION OF DRAWINGS

Practical implementation for this invention is diagrammatically illustrated, by way of example, in the accompanying drawings in which:

FIGS. 3 and 3A are partial perspective and scrap sectional views of a plastics injection moulding 35 formed as a wall member having stiffening ribs 36 which intersect with a rectangular border 31 as a restraining edge of an acoustically active panel area 30, the border 31 also being formed by raised ribs that stiffen the edges of the operative panel area 30;

DETAILED DESCRIPTION

Figure 1:
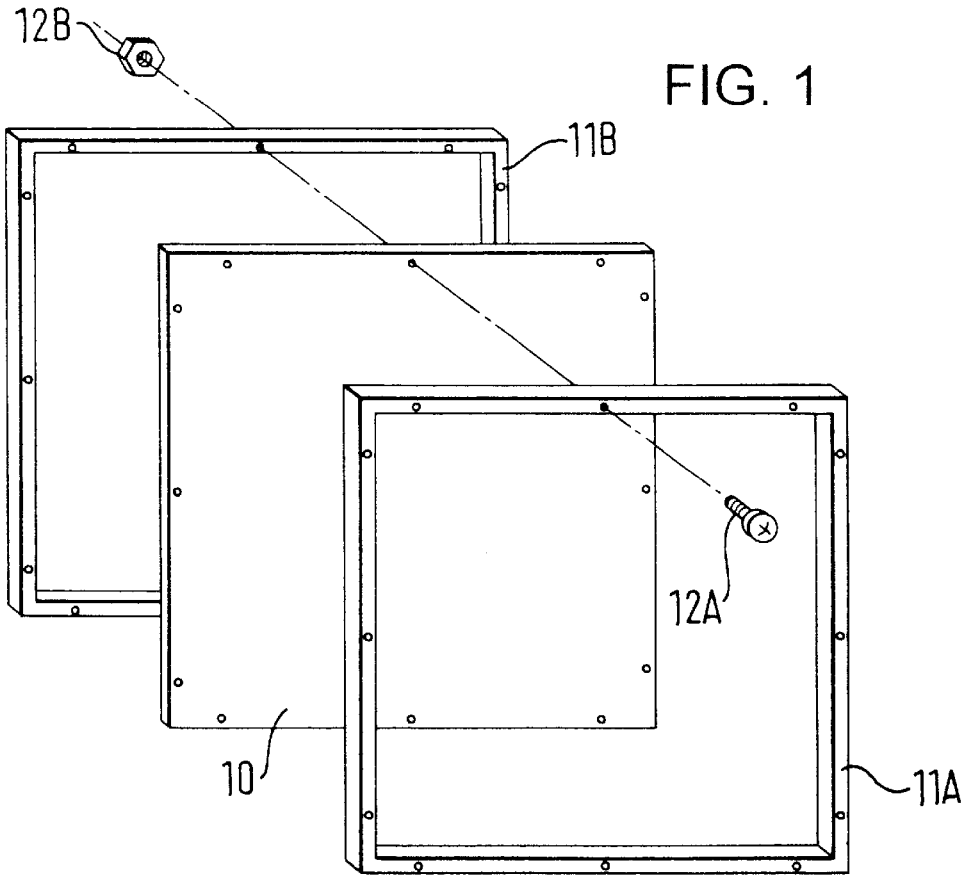
FIGS. 1 and 1A are exploded perspective and scrap sectional views of a resonant generally rectangular panel acoustic member 10 clamped at its edges between opposed rectangular perimeter frame members 11A,B using bolts and nuts 12A,B which may be further useful for mounting to a chassis or other mother structure.
Figure 1A:
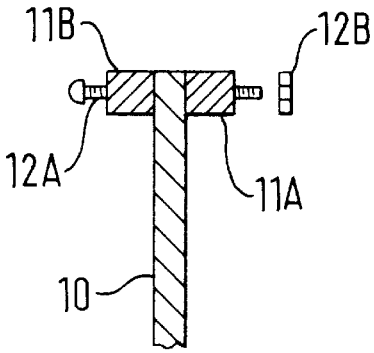
Figure 2:
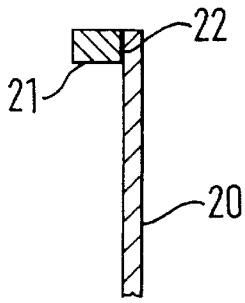
FIG. 2 is a scrap sectional view showing alternative edge clamping/terminating of resonant panel acoustic member 20 by edge fixing to a frame 21 by means of an adhesive 22.

Relative to FIGS. 1 and 2, the acoustic member may be and are shown as substantially rectangular and may have aspect ratios as considered preferential in W097/09842, though much wider ranges of aspect ratios will be shown to have useful potential within a general objective to obtain high modal density and even-ness of modal spread in the member.

Figure 4:
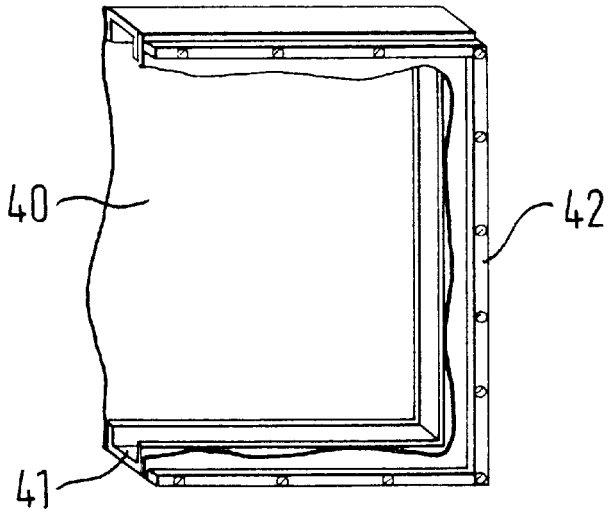
FIG. 4 is a partial perspective view of a resonant panel acoustic member 40 stretched over a frame 41 and clamped at its edges by a surrounding clamping frame member 42.
Figure 4A:
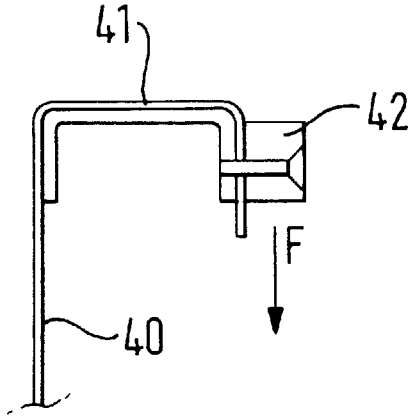
FIG. 4A is a partial cross-section of the embodiment of FIG. 4.

FIGS. 4 and 4A show an embodiment of resonant acoustic member 40 stretched over a rectangular perimeter frame 41 and clamped to the rectangular perimeter frame by a clamping frame 42 to hold the acoustic member in place. Tensioning force is applied to the member 40 in the direction of arrow F. As an alternative, as shown in FIG. 4B, the clamping frame 42 may be replaced by tensioning means 43, e.g. including tension springs 44 on a frame 45, the tensioning means being fixed to the edge of the acoustic member to stretch the member over the rectangular perimeter frame.

Figure 4B:
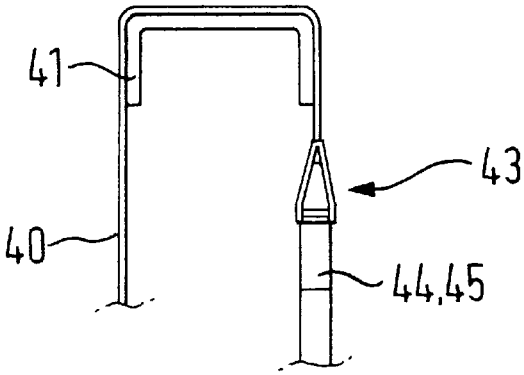
FIG. 4B is a partial cross-section similar to that of FIG. 4A of alternative embodiment of resonant stretched panel acoustic member.

Vibration exciters, e.g. of the kinds described in WO97/09842, may be located on the acoustic members in the embodiments of FIGS. 4,4A and 4B to excite resonance in the acoustic members to produce an acoustic output so that the acoustic members can act as loudspeakers or loudspeaker drive units. These vibration exciters are not shown in FIGS. 4,4A and 4B in the interests of clarity.

Strong restraint or clamping of panel edges enables use of relatively low stiffness materials (compared with general practice for substantially free edge panels), which can assist by lowering fundamental bending mode frequencies of panels, including even below levels practical for typically stiffer substantially free-edge panels (and despite effectively losing the lowest frequency free-edge mode in a fully clamped panel). For example, where the range of stiffness for a practical example of a free edge panel of the kind described in W097/09842 may be of the order of 0.1 to 50 Nm, the stiffness of a clamped edge panel of the same general kind may be lower by at least one order of magnitude, even as low as 0.001 Nm. Also, where the range of surface density of the said practical example of free edge panels may be 100 to 1000 $g/m^2$, the surface density of clamped edge panels may be only a fraction, even as low as 25 $g/m^2$. It will, however, be appreciated that significantly stiffer and/or denser materials may be employed for acoustic panels hereof with substantial edge restraint or clamping, at least where lowest frequency performance is not a requirement. Such applications include tweeters, sirens, ultrasonic sound reproducers.

Use of panel materials of relatively low rigidity can result in higher coincidence frequency, e.g. above the normal audio band, which may improve the uniformity of sound directivity from resonant loudspeaker panel. Also, less rigid panels, can afford effective augmentation of modal density in the lower registers, consequently improved sound quality.

Useful variants to the fully peripherally edge/boundary-restraint/clamping as illustrated include any effective lesser extent of substantial restraint/clamping which, for substantially rectangular panel member/active area, could be one side by omission of what is shown for three sides, or two typically parallel sides by omission of what is shown for other two sides.

Acoustic radiating members hereof may be excited in any of the ways suggested in W097/09842, e.g. by way of at least one inertial electro-mechanical exciter device. The or each exciter device may be arranged to excite the radiating member at any suitable geometric position(s) areally of the acoustic member; whether according to principles as in W097/09842 or in accordance with mechanical impedance analysis as in PCT/GB99/00404 or as determined experimentally. Such vibration exciters have been omitted from FIG. 1 in the interests of clarity.

Reference is made to W097/09842 as to applicable kinds of exciters, and the positioning of such exciters may be as determined in accordance with the same principles as taught in W097/09842 and/or PCT/GB99/00404, usually with difference available for actual locations compared with WO97/09842.

Figure 10:
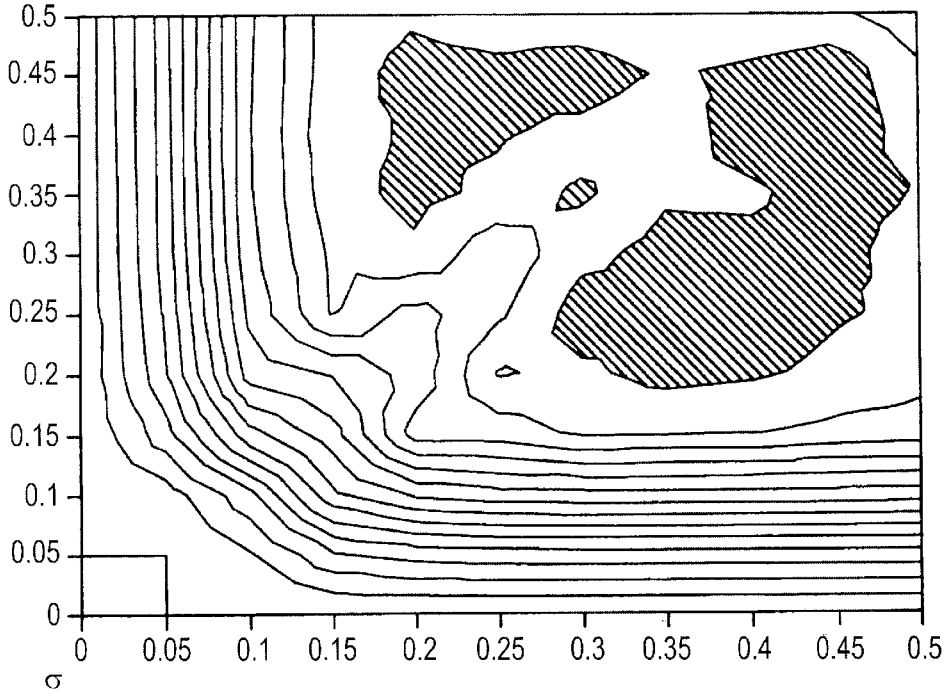
FIG. 10 is a calculated quarter panel mechanical impedance plot for one clamped edge panel member.
Figure 11:
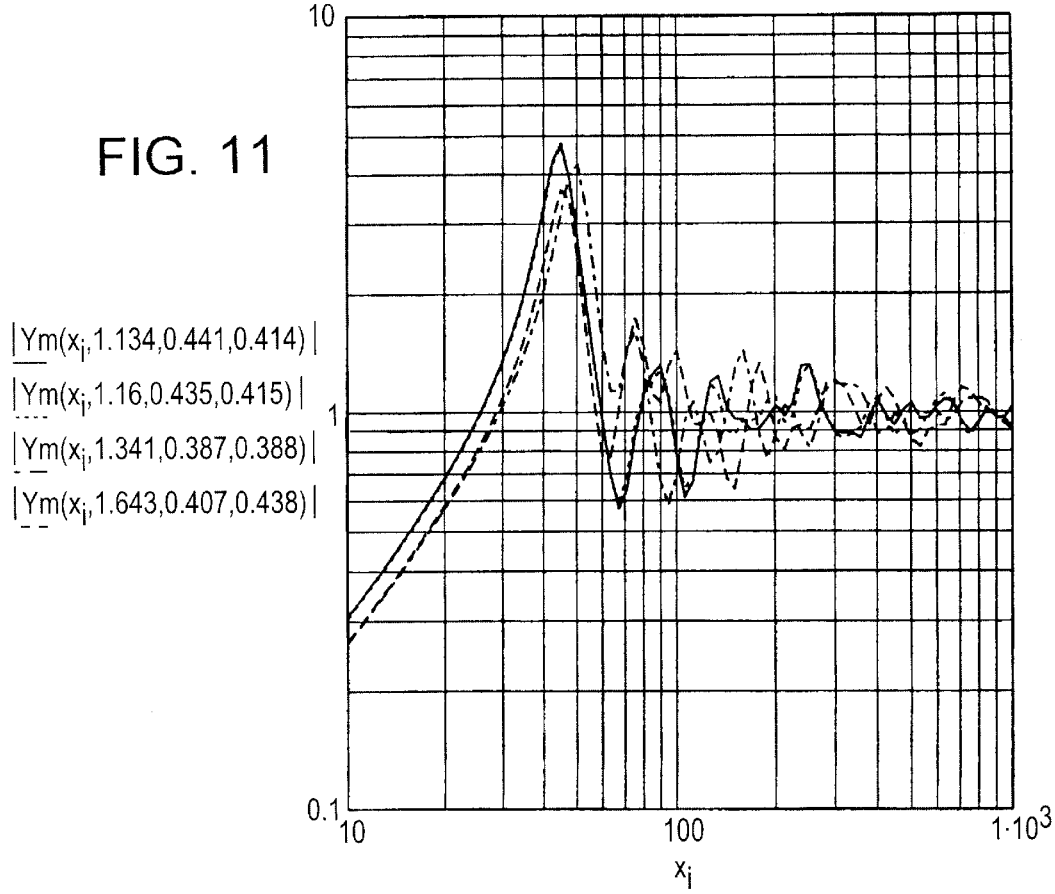
FIG. 11 is a graphical representation for various clamped edge panel aspect ratios.
Figure 12A:
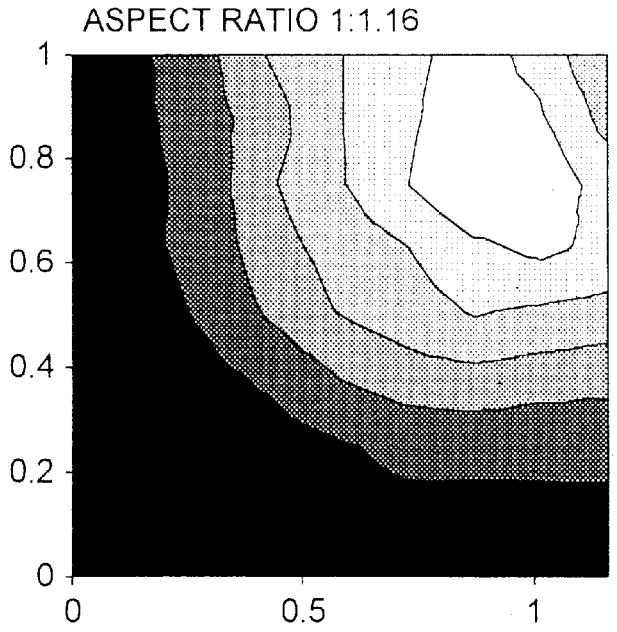
FIGS. 12A–H are measured quarter panel mechanical impedance plots for various aspect ratios.
Figure 12B:
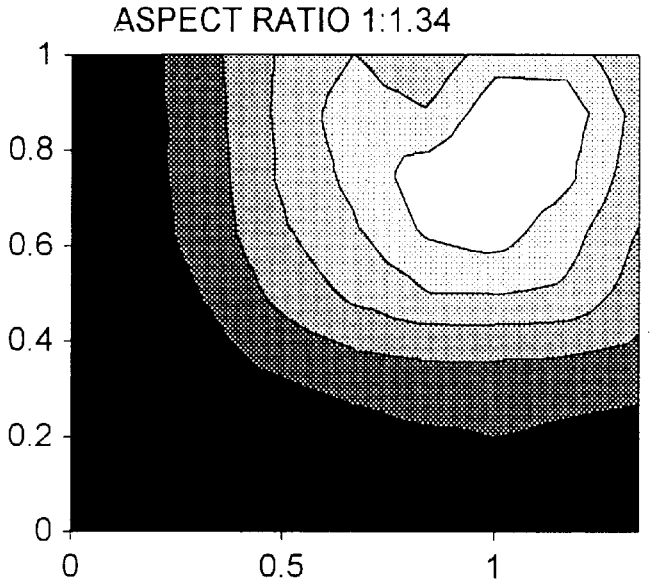
Figure 12C:
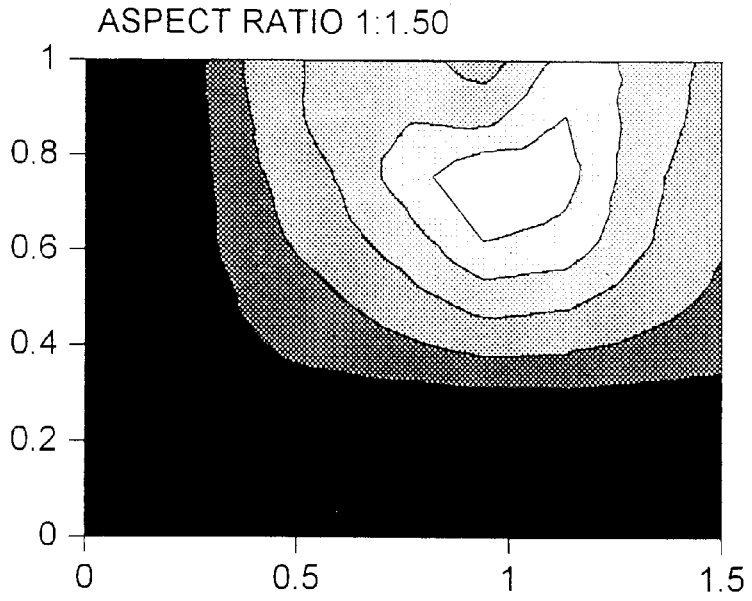
Figure 12D:
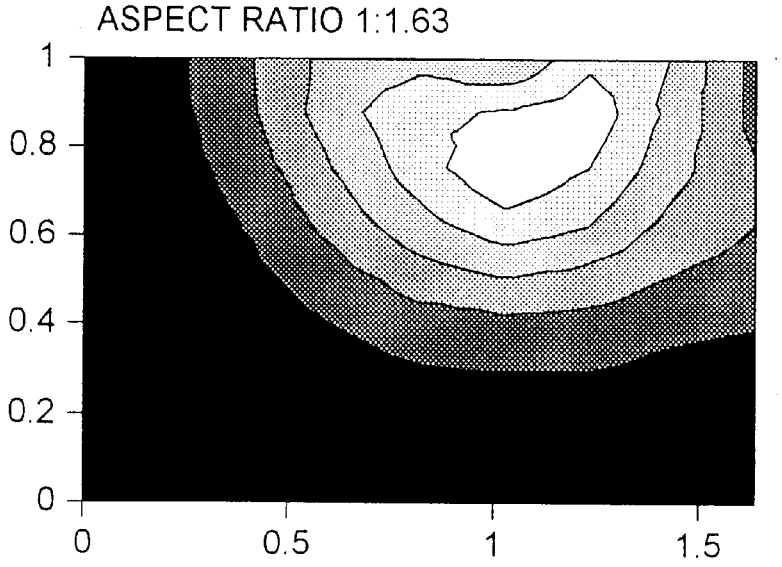
Figure 12E:
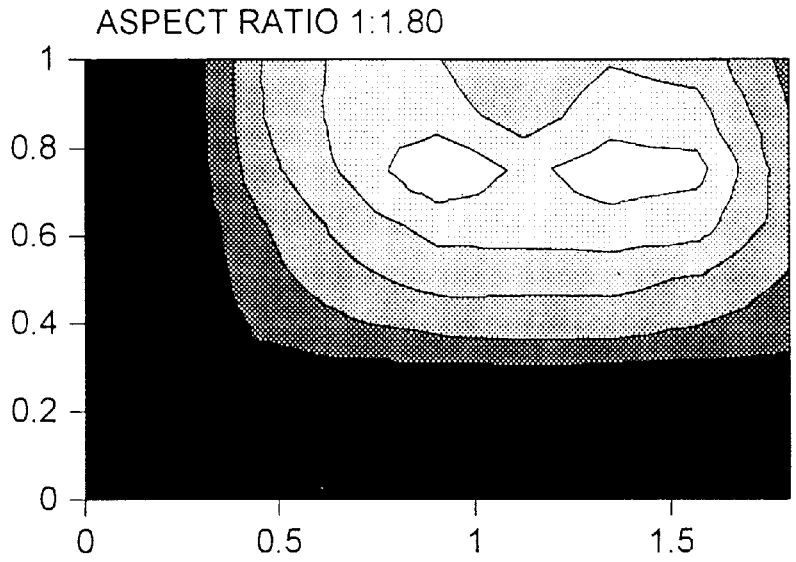
Figure 12F:
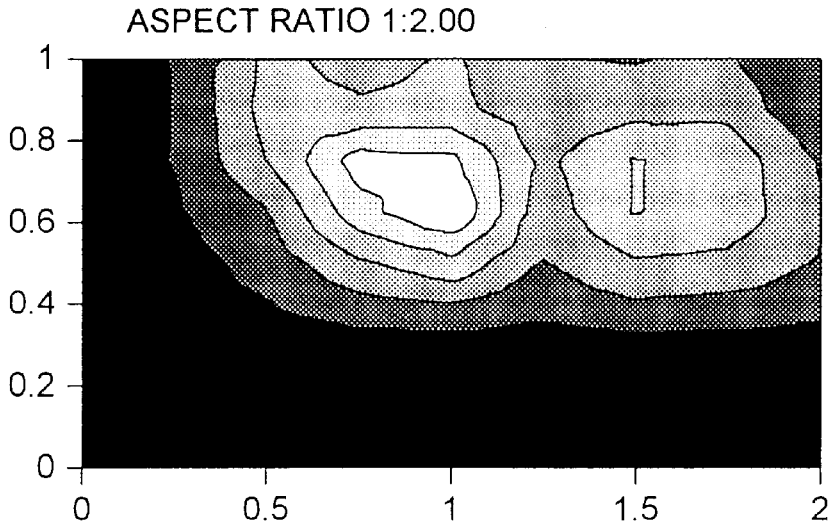
Figure 12G:
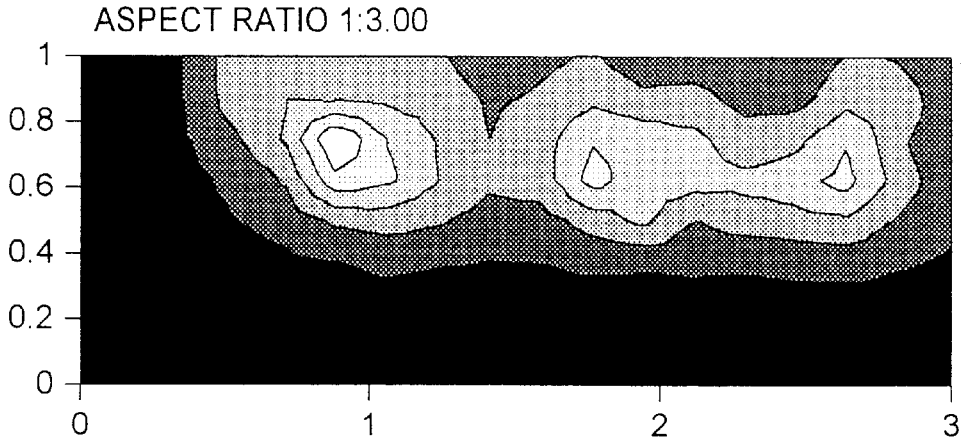
Figure 12H:
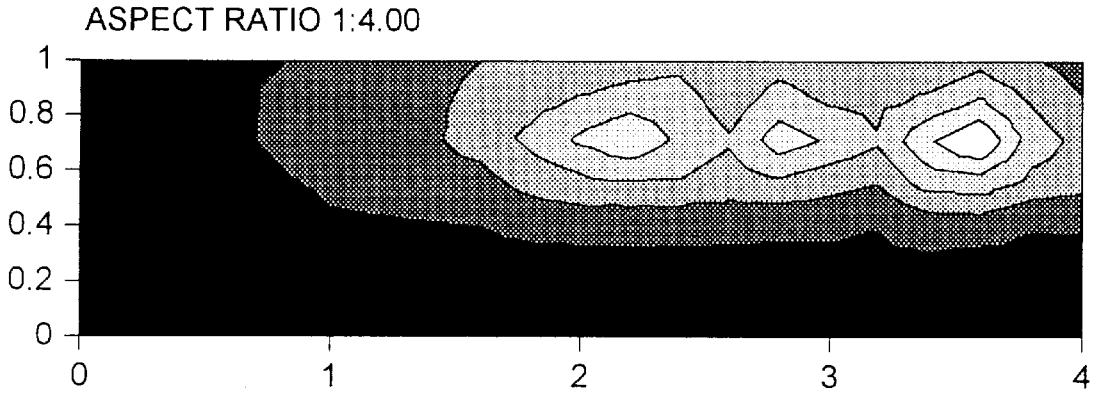
Figure 13A:
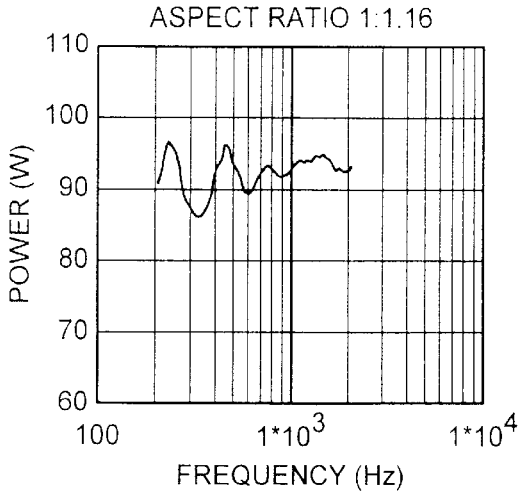
FIGS. 13A–H are related acoustic output plots as fitted to a reference value.
Figure 13B:
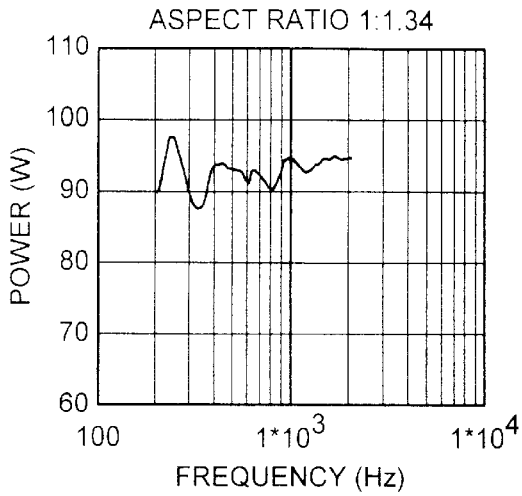
Figure 13C:
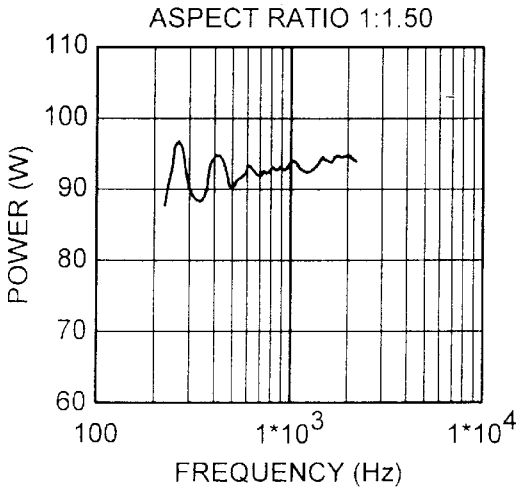
Figure 13D:
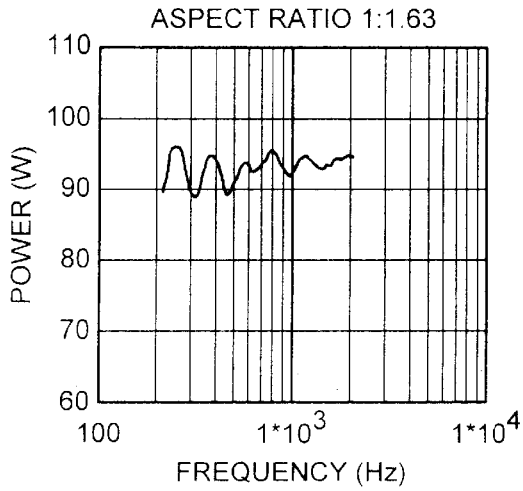
Figure 13E:
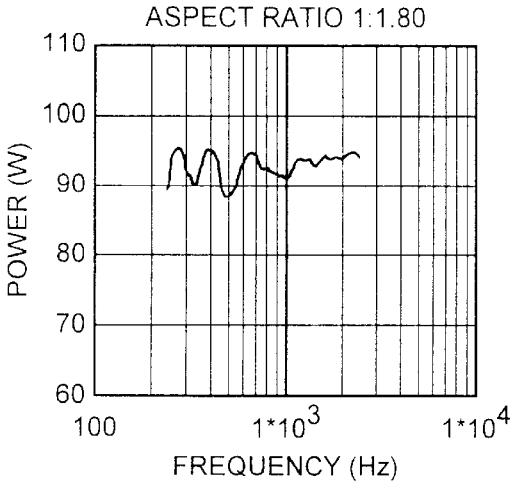
Figure 13F:
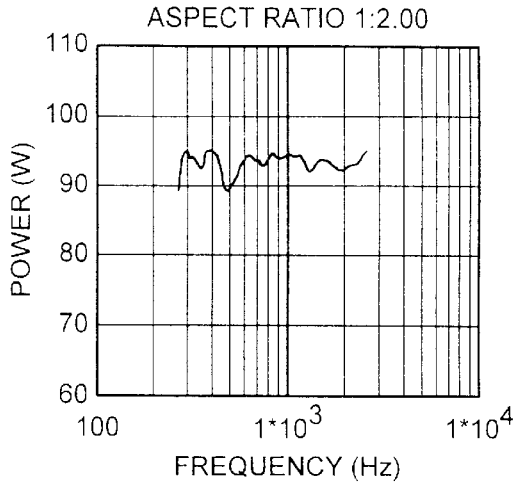
Figure 13G:
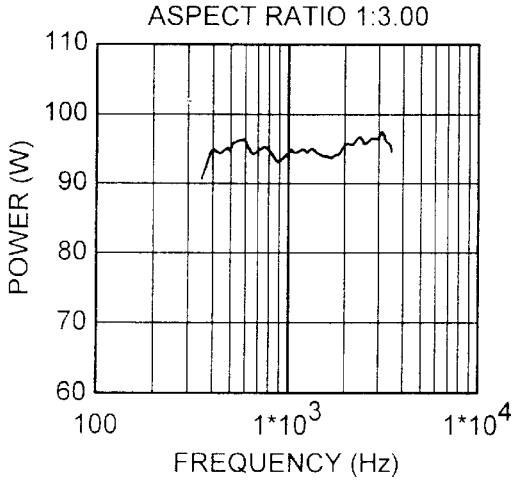
Figure 13H:
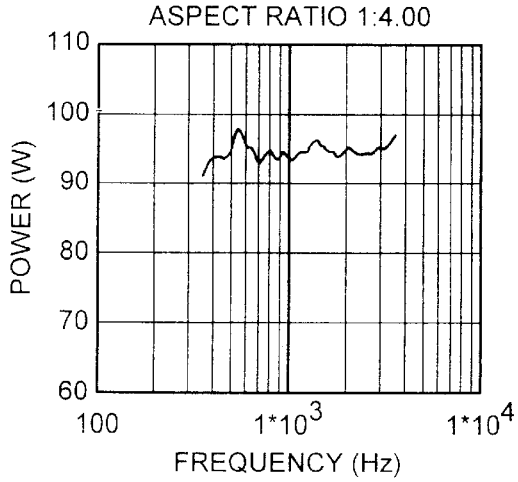

Some useful investigations of fully edge-clamped resonant panel members as or in active acoustic devices, specifically loudspeakers, are first disclosed in and relative to FIGS. 11 to 16 of co-pending PCT application PCT/GB99/00404 as filed on Feb. 9, 1999; and those figures are repeated herein as FIGS. 6 to 11, respectively. Those investigations are, of course, based on analysis involving parameters of power transfer, particularly smoothness of input power, specifically as related to mechanical impedance; and particularly as impacting on viable-to-optimal transducer locations and panel member shapes, specifically aspect ratios for at least substantially rectangular panel members and transducer locations on a proportionate co-ordinate basis. Thus, the graphical representations of FIGS. 6A,B and 7A, B and 8A,B for mechanical impedance with frequency for panel members of selected aspect ratios and isotropic as to bending stiffness are accompanied by graphical representations of FIGS. 9A, B, C for smoothed mechanical impedance as measured by inverse square of mean standard deviation for location of particular promising transducer locations. Precisely calculated favourable aspect ratios 1.160, 1.341 and 1.643 are revealed together with likewise precisely calculated preferential transducer location co-ordinates (0.437, 0.414), (0.385, 0.387) and (0.409, 0.439), respectively. FIG. 10 is a calculated quarter-panel mechanical impedance plot for the aspect ratio 1.16 and shows substantial extent of areas promising for transducer location, even two such separate areas (cross-hatched). FIG. 11 gives. comparison of such preferential clamped edge aspect ratios and transducer locations, including further for aspect ratio 1.138.

Further investigations hereof are based on actual measurements for mechanical input power involving substantially rectangular resonant panel members having increasing aspect ratios; and in each case making a fit of frequency response to a reference value or flat line for a decade above lowest effective resonant mode frequency. Quarter panel contour plots of inverse of the mean square deviation of such fit are given in FIGS. 12A–H including for same or close to above aspect ratios (FIGS. 12A,B, D), and corresponding FIGS. 13A–H for the flat line frequency fits, respectively, the lightest colouration/shade representing the most viable transducer location(s) and breaking into discrete areas of indicated viability at higher aspect ratios.

Figure 5A:
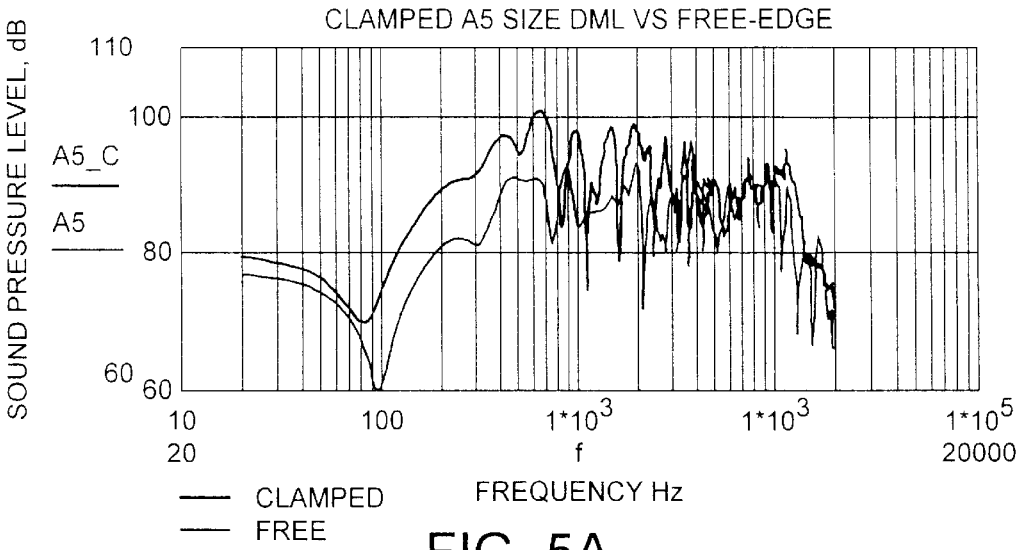
FIGS. 5A,B are graphs showing frequency response of respective resonant panel members of A4 and A5 size, respectively, and in which the heavy line traces represent a clamped edge panel and the fine line traces represent a free or resiliently edge suspended panel.
Figure 5B:
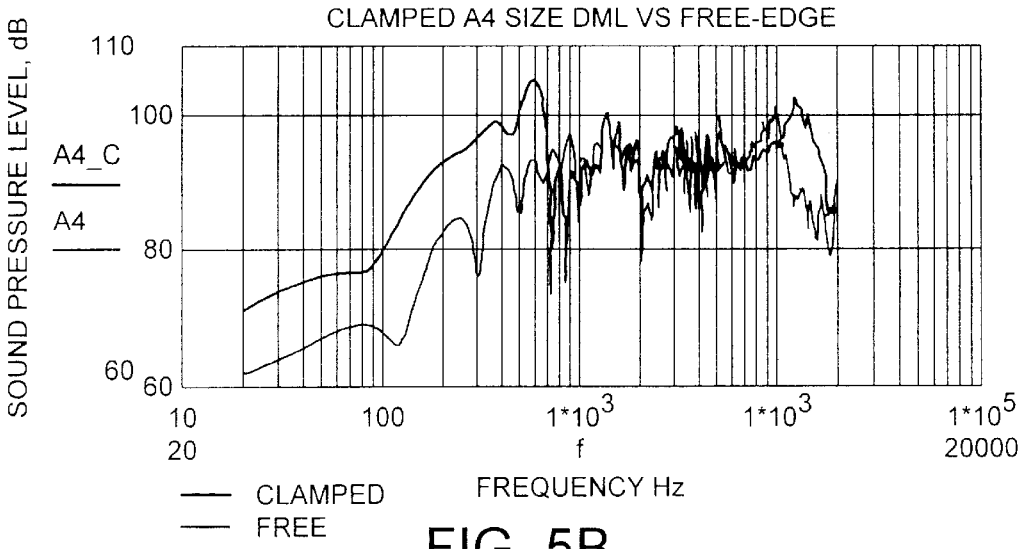
Figure 6A:
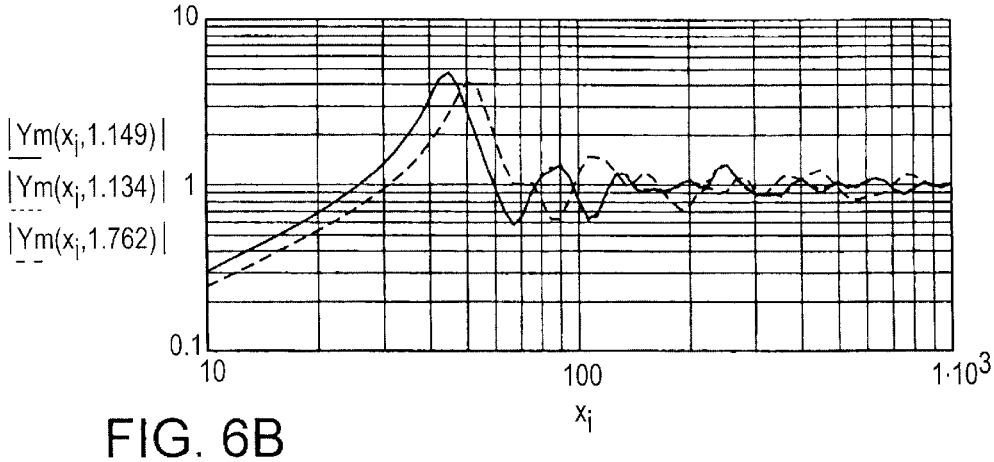
FIGS. 6A,B and 7A,B and 8A,B are graphical representations for mechanical impedance against frequency for selected aspect ratios of clamped edge panel members.
Figure 6B:
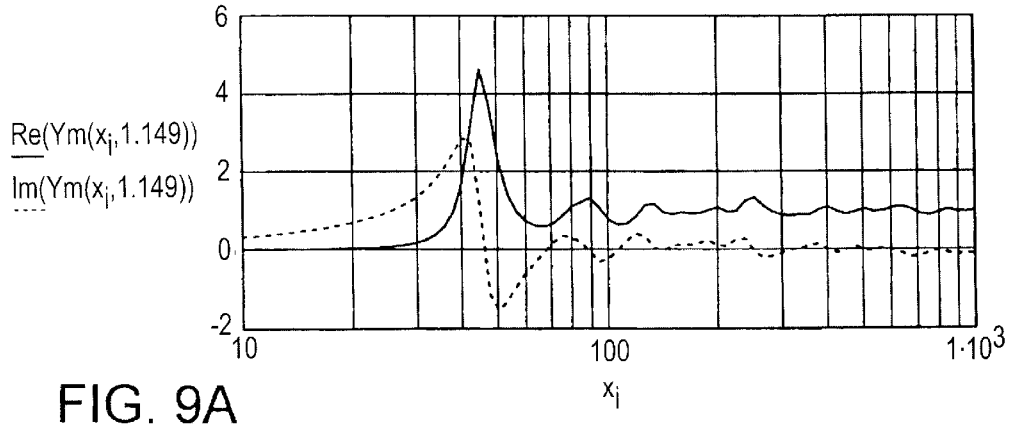
Figure 9A:
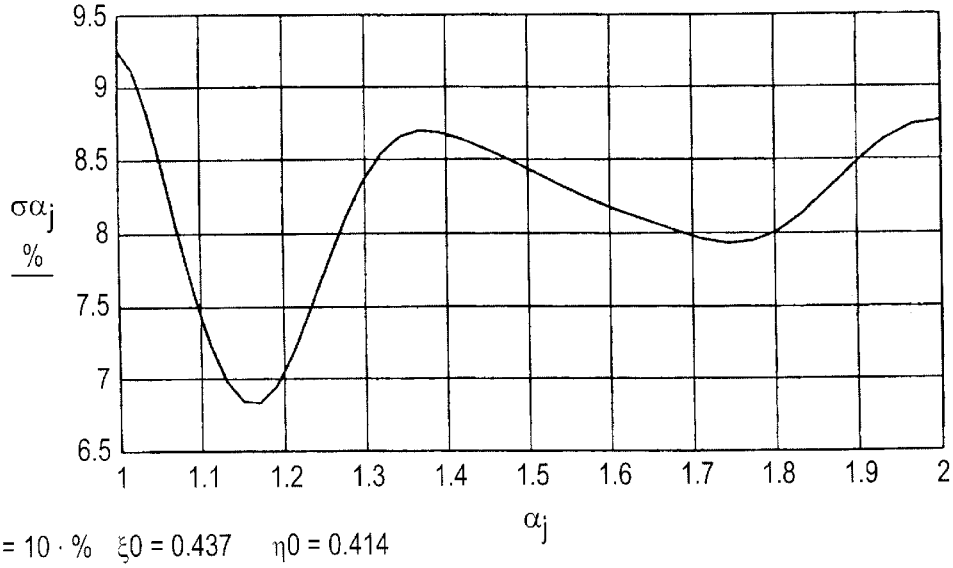
FIGS. 9A,B,C are graphical representations of related smoothed inverse mean square deviation for location of transducer means.
Figure 7A:
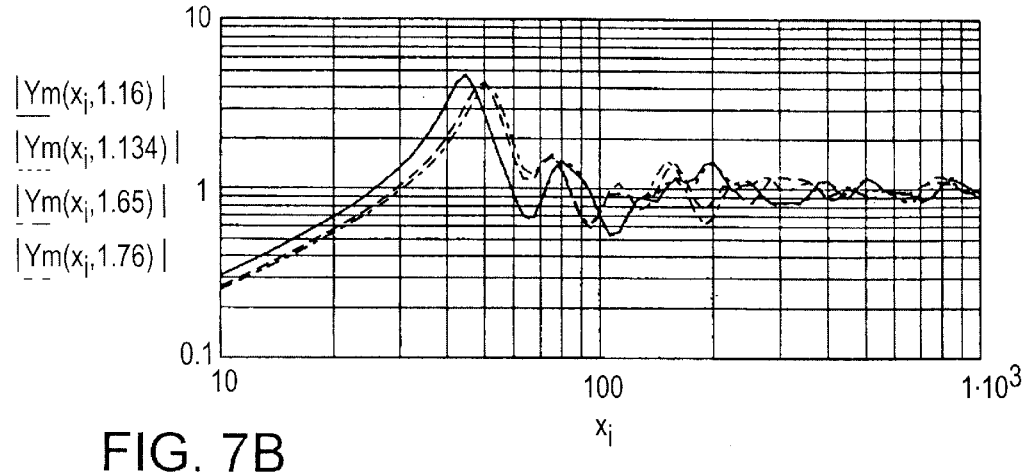
Figure 7B:
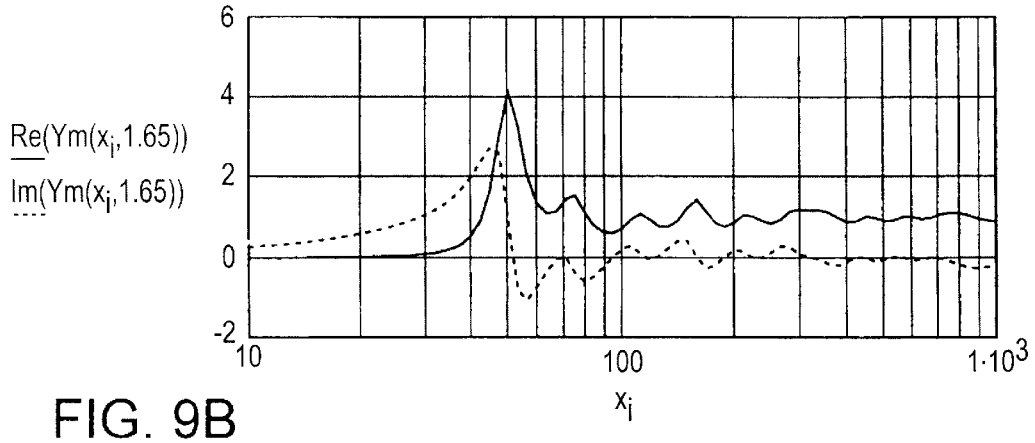
Figure 9B:
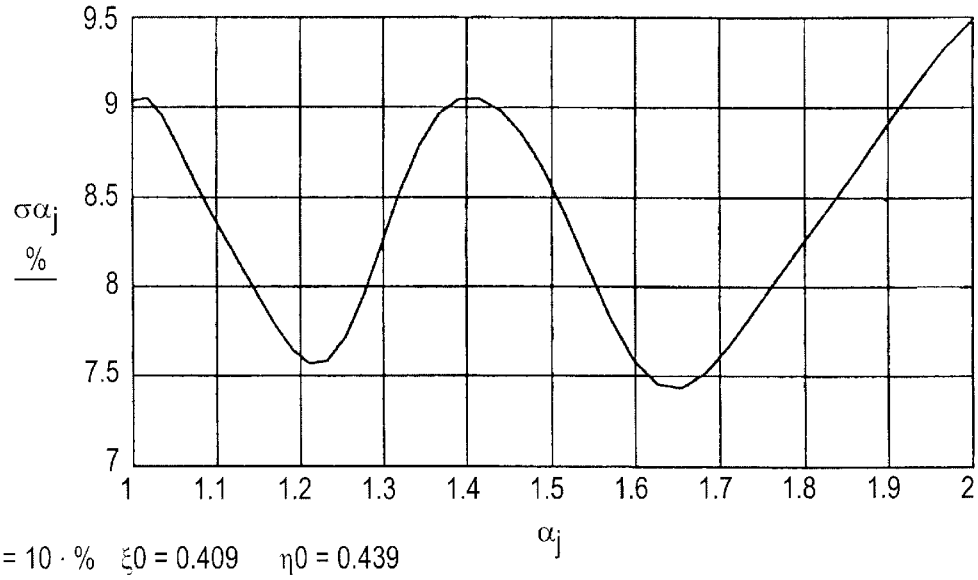
Figure 8A:
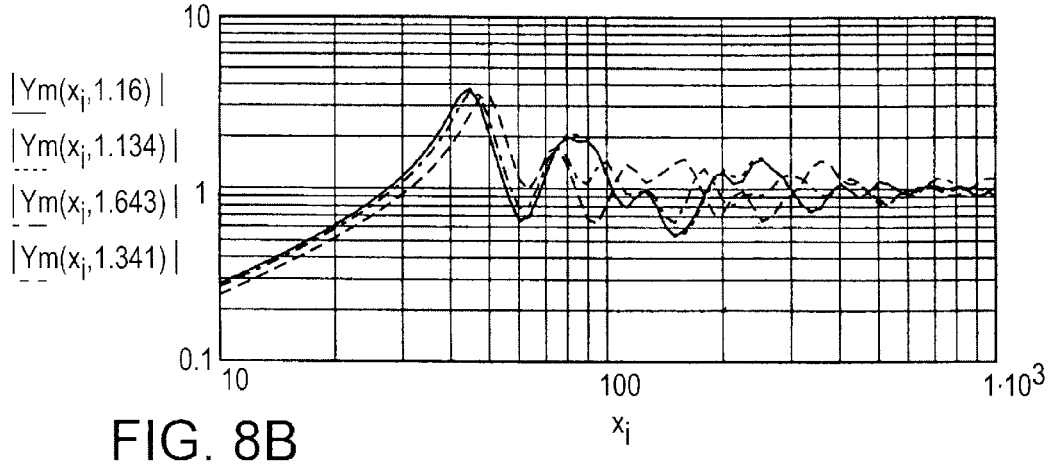
Figure 8B:
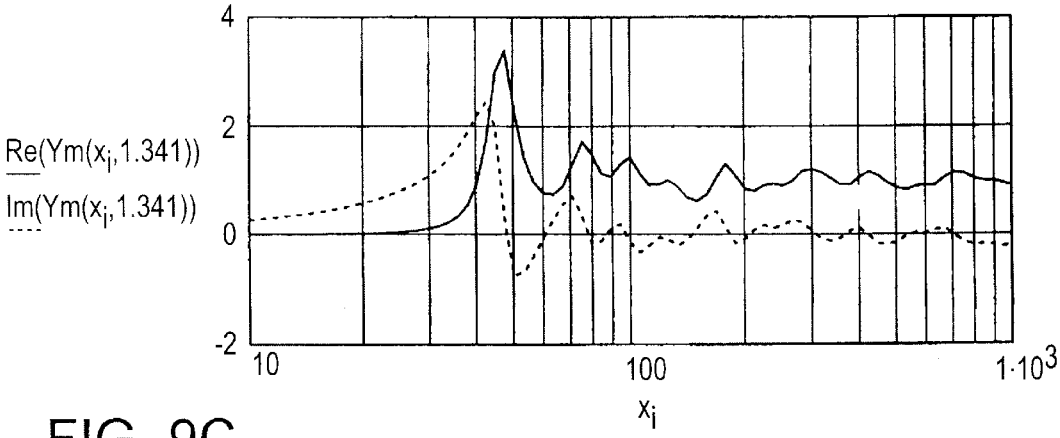
Figure 9C:
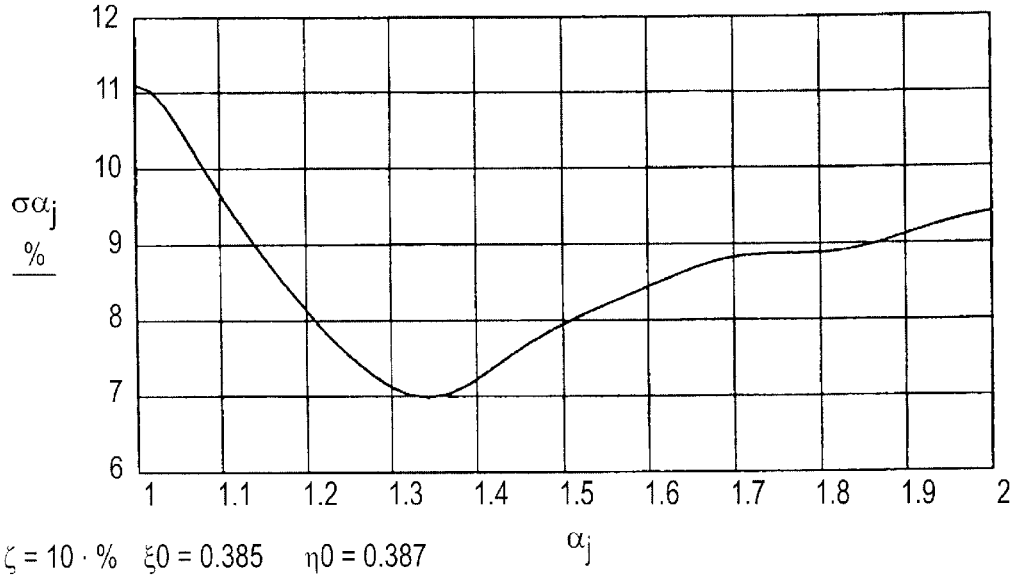

Extension of these further investigations to aspect ratios as high as 1:4 is noteworthy, perhaps especially establishment of viability clear through from at or near square. This is unexpected, to say the least, from the background of our prior revelatory work and teaching concerning resonant panel members with edges substantially free for bending wave vibration. The also hitherto unexpected increase of operational power as established herein from FIGS. 5A, B for aspect ratio 1.41, is further established as consistent through other aspect ratios now investigated. The further unexpected marked reduction of criticality of aspect ratios to give even spacings of resonant mode frequencies as beneficial for acoustic action has given cause for further detail consideration and analysis. The following outcome is presented in terms of simplified beam theory for substantially rectangular resonant panel members having substantially isotropic bending stiffness.

Generally, there is confirmation of prior work/teaching, namely that, for substantially free-edge panel members, lowest resonant mode frequency as determined by the longer side dimension and is best in conjunction with shorter side dimension corresponding to a next higher resonant mode frequency giving related respective series of higher resonant mode frequencies that are substantially interleaved in values. Indeed, a high aspect ratio for such a substantially free edge panel would result in the second (perhaps even more) of the resonant mode frequencies of the panel member directly attributable to the longer edge dimension also being lower than the first attributable to the shorter edge dimension, thus frequency gap(s) too large for truly satisfactory acoustic performance relying on bending wave action at such lower frequencies concerned.

By contrast, the first effective resonant mode frequency for a fully edge-clamped resonant panel member effectively requires contribution by the first resonant mode attributable to the shorter edge length, i.e. the first combination mode for plate vibration action for the two series ($fx_1$, $fx_2$: . . . $fx_n$) and ($fy_1$, $fy_2$ . . . $fy_m$) for the edge-parallel axes x,y as represented by the resonant mode spectrum equation:

$$fxy_{nm}=\sqrt{(fx_n)^2+(fy_m)^2}\quad n\geqq 1\ m\geqq 1$$

Figure 14:
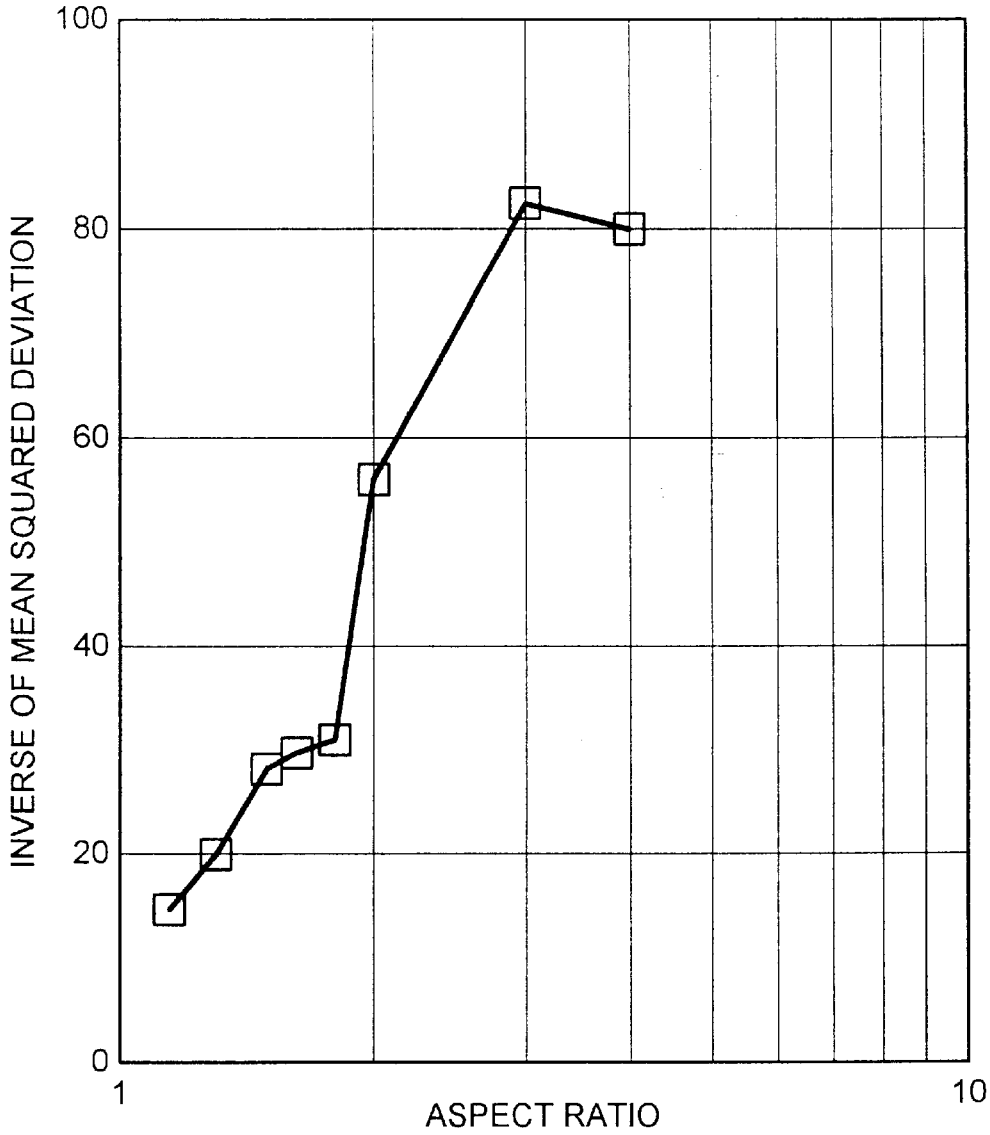
FIG. 14 plots maximum inverse mean square power deviation for different aspect ratios.
Figure 15A:
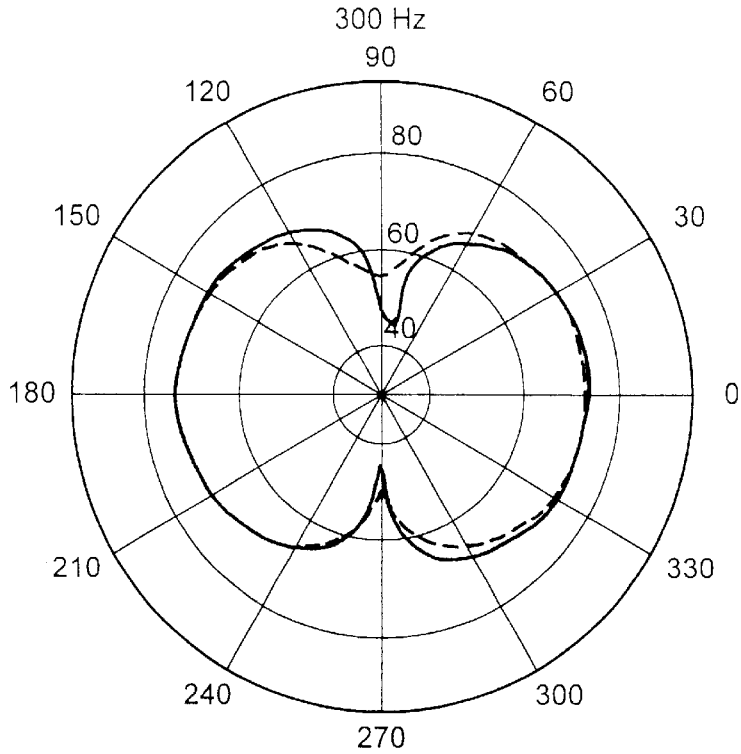
FIGS. 15A–J are combination polar plots of acoustic output for lower resonant modes of a 1:3 aspect ratio clamped edge panel member.
Figure 15B:
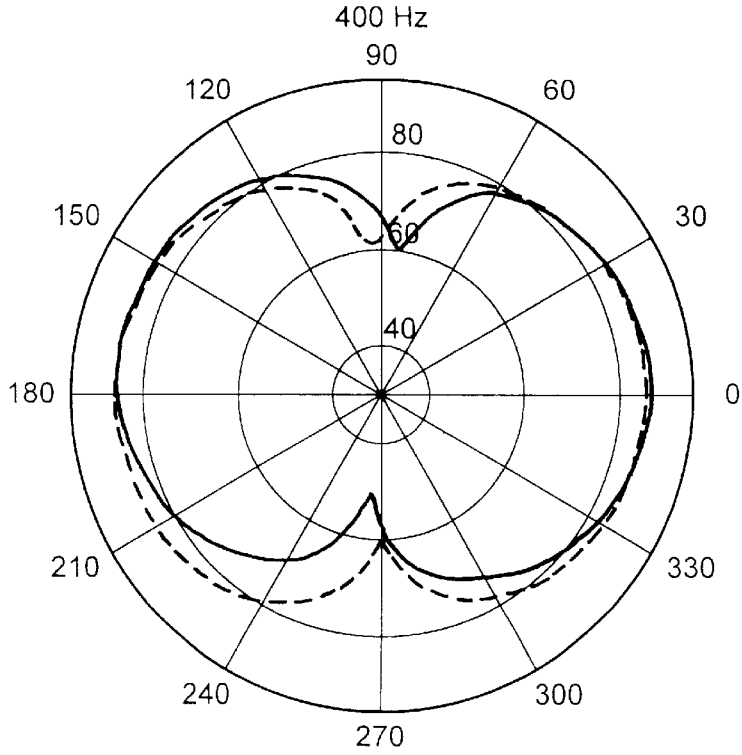
Figure 15C:
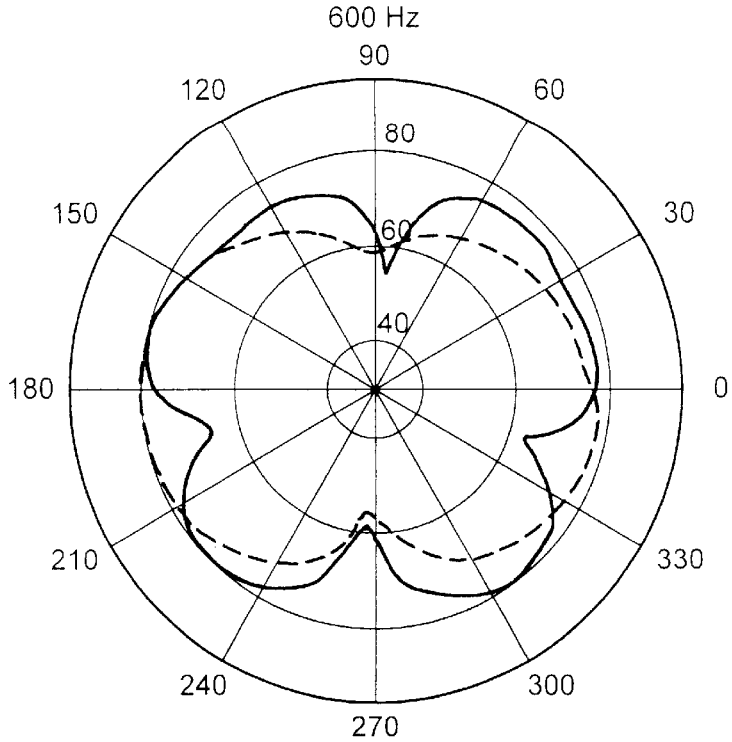
Figure 15D:
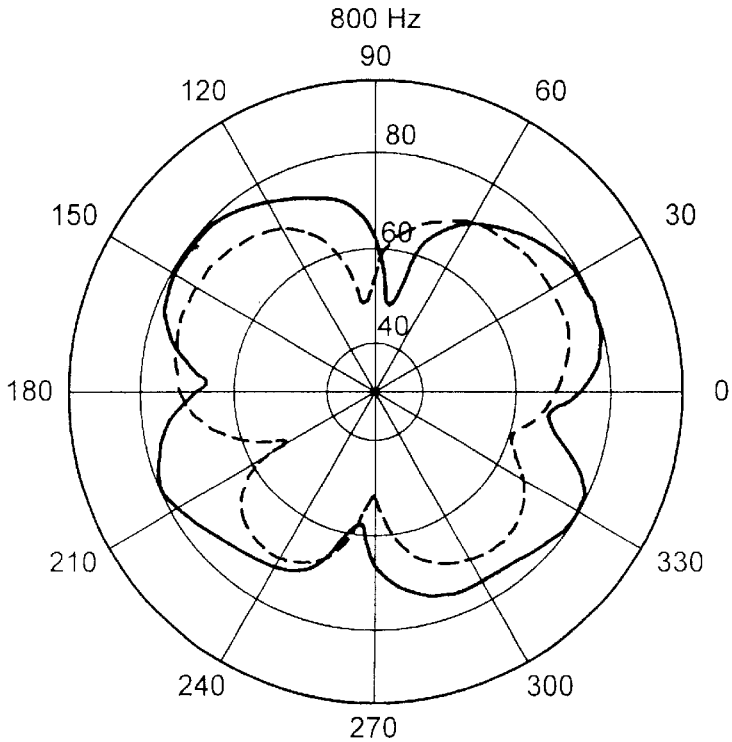
Figure 15E:
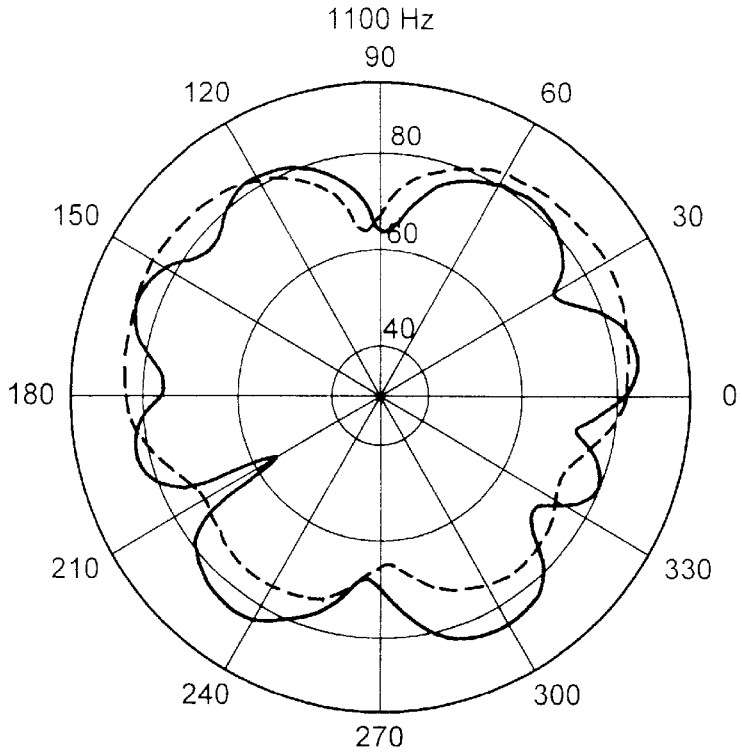
Figure 15F:
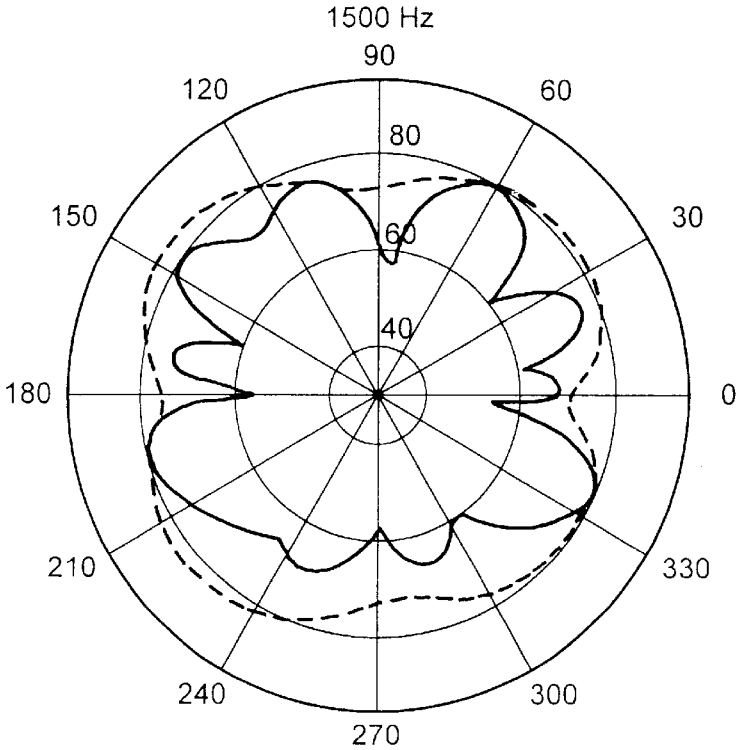
Figure 15G:
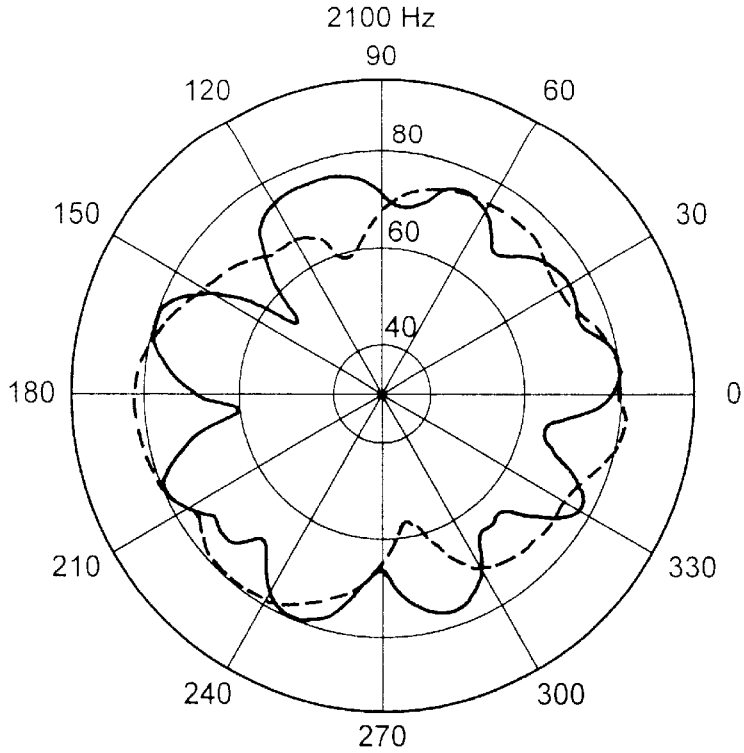
Figure 15H:
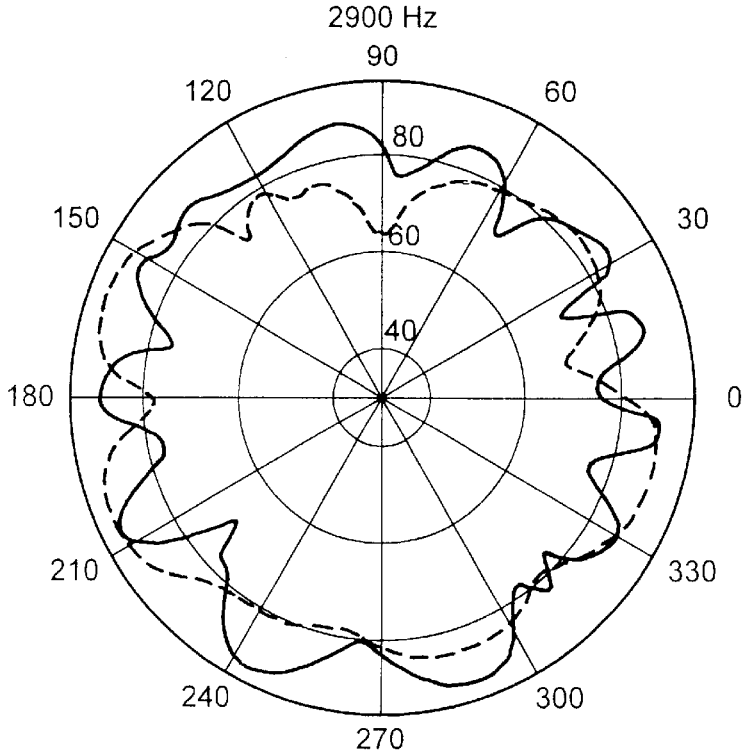
Figure 15I:
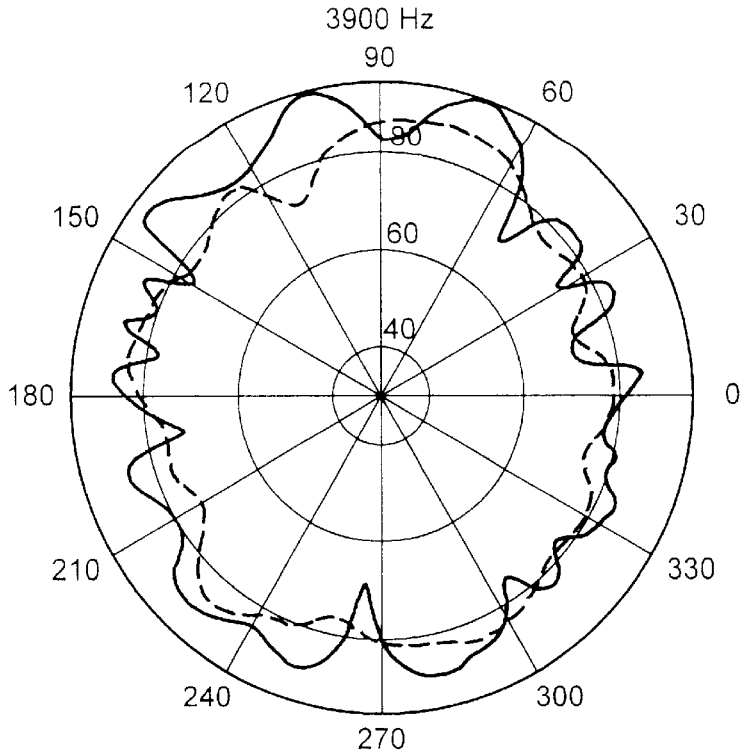
Figure 15J:
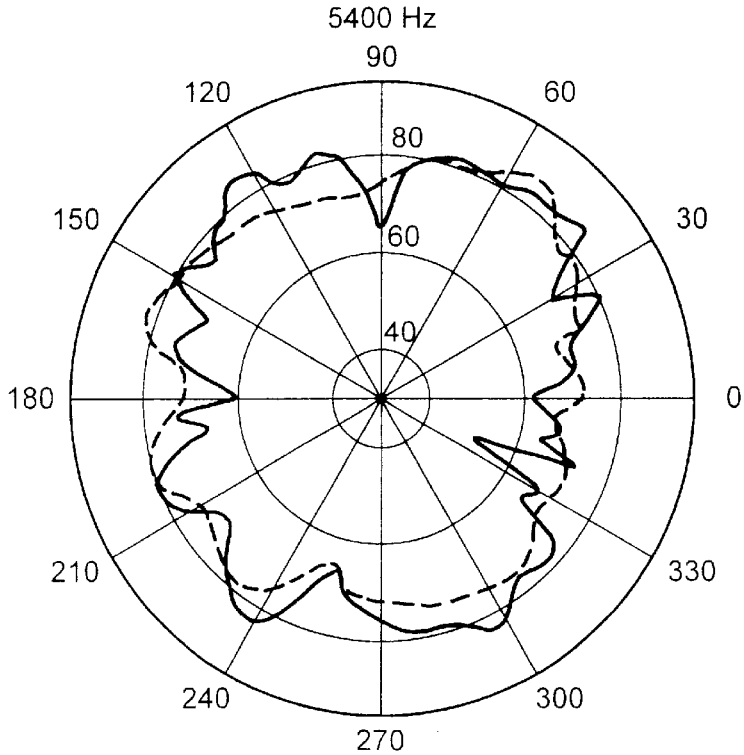

The effect of this quadrature relationship is that a high aspect ratio can produce a succession of quite closely spaced resonant mode frequencies attributable to contributions by those next higher in the longer edge related series before next contribution from the next higher shorter edge related series. FIG. 14 plots maximum inverse mean square power deviation against aspect ratio and shows increase of power smoothness (above lowest effective resonant mode) with increasing aspect ratio peaking at about 1:3. Effectively, higher aspect ratios for boundary restrained members hereof have closer resonant mode frequencies, whereas the opposite applies to relatively free edge panels of WO97/09842.

This result, does not, of course, in any way derogate from good and useful results for acoustic devices using smaller aspect ratio, fully edge clamped, resonant panel members; which is also fully practical with desirable acoustic device operation from resonant mode frequency interleaving as foreshadowed by the above analysis also in PCT/GB99/00404.

There are, however, significantly greater design possibilities. In any particular case, and desired application for acoustic devices hereof, particular spectra of resonant mode frequencies will obviously vary with aspect ratio for given bending stiffness or ratios thereof; and choice will often be made on calculable, measurable or perceived results as to desired or acceptable acoustic device performance.

Another relevant factor has been established and investigated, namely axis-related and/or attitude-related acoustic action and performance, for which differences can be significant; and be useful/effective in design of particular acoustic devices for particular applications, particularly where such differences may be positively desirable or may be undesirable, or some particular combination preferred or acceptable. FIGS. 15A–J are combination polar plots for one resonant panel member of aspect ratio 1:3 for the lower resonant mode frequencies, respectively; and in each case show landscape (solid) and portrait (dashed) planes, i.e. with longer dimension horizontal or vertical, respectively. Generally, as was expected, the radiation patterns are significantly different, that in the plane of the smaller length being generally smoother, and that in the plane of the longer length being more diffuse. Design options include acceptability of higher frequency of lowest resonant mode, as directly dependent for any particular panel member structure on aspect ratio; acceptability of directionality where panel member vibration is markedly different in different axial directions; consequentially different power smoothness in corresponding radiation planes; related selection of orientation or attitude of the panel member as used; and available trade-offs between power smoothness in different planes and/or of total power smoothness against similarity or otherwise of responses in landscape/portrait or azimuth/elevation planes.

Figure 16A:
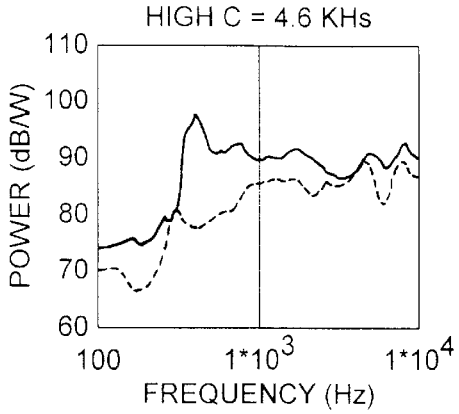
FIGS. 16A–D are acoustic output power comparison plots for specific panel structures differing in size and/or stiffness.
Figure 16B:
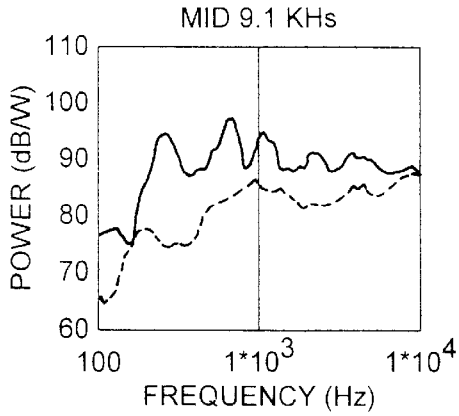
Figure 16C:
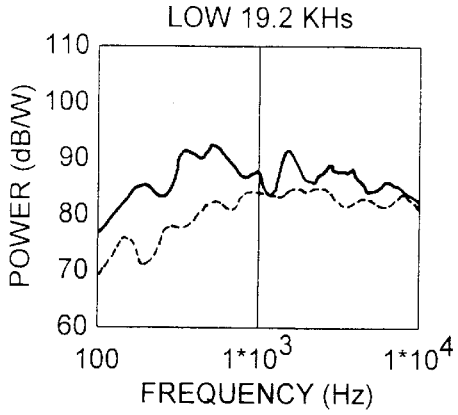

The panel member of FIG. 16A comprises 0.05 mm thick black glass skins on 4 mm thick Aluminium honeycomb, resulting in substantially isotropic bending stiffness of 12.26 Newtonmeters, mass density of 0.76 Kilogram/square meter, and coincidence frequency of 4.6 kHz. The panel member of FIG. 16B comprises 0.102 mm thick black glass skins on 1.8 mm thick Rohacell core, resulting in substantially isotropic bending stiffness of 2.47 Newtonmeters, mass density of 0.60 Kilogram/square meter, and coincidence frequency of 9.1 kHz. The panel member of FIG. 16C comprises 0.05 mm thick Melinexυ skins on 1.5 mm Rohacell core, resulting in substantially isotropic bending stiffness of 0.32 Newtonmeter, mass density of 0.35 Kilogram/square meter, and coincidence frequency of 19.2 kHz. These panel members are all of similar aspect ratio between 1.13 and 1.14 and driven with like exciters of 13 mm active diameter and input impedance of 8 ohms. Each had acoustic power output measured with all panel edges free to vibrate for resonant bending wave action of the panels, and with all edges clamped against such vibration. FIGS. 16A–C show that clamping achieves substantial increase in acoustic output power below coincidence frequency, though not above, so there is greater beneficial impact of clamping the higher the coincidence frequency, thus the lower the bending stiffness of the panel member concerned.

Figure 16D:
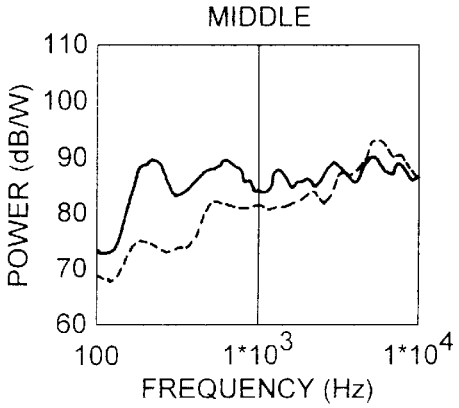
Figure 16E:
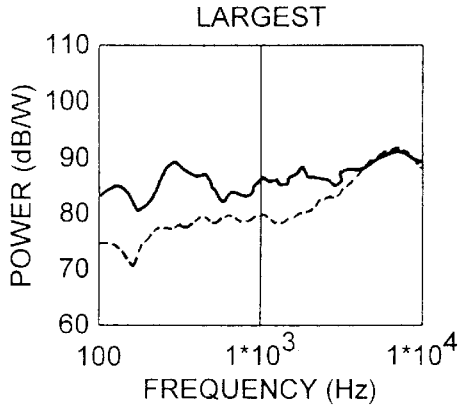

The panel members for FIGS. 16D–E are of the same stiffest structure as FIG. 16A, but of larger sizes, namely 360 mm×315 mm and 545 mm×480 mm, respectively compared with 260 mm×230 mm for FIGS. 16A to D; and there is confirmation of full clamping producing improved acoustic output power from coincidence frequency down to the lowest resonant mode frequency of the panel member concerned specifically to about 400 Hz for the smallest panel members (FIGS. 16A–C) and lower for the larger and largest panel members. It is also worth noting that the larger the panel members the closer the mode shapes for given frequency approximate to a sine wave.

Check measurements were made of mechanical input power for all of these panel members when driven with edges free to vibrate and with edges fully clamped, and showed that all of the panel members took in much the same power.

It may be interest to speculate regarding assumption, prior to the contrary teaching of WO97/09842, regarding useful acoustic radiation being unavailable below coincidence frequency based on the theory that such is to be expected of perfect sine waves in an infinite plate; and assumptions consequential to the teaching of W097/09842 clearly establishing that useful acoustic radiation is available in a finite plate below coincidence, namely that such radiation results from parts of the finite plane that vibrate deviantly from perfect sinusoidal distribution, as appears mainly to be the case for lowest frequency modes and both near to an exciting transducer and at edges that are free to vibrate, hence, of course, emphasis hitherto on the latter. However, by the teaching hereof, it is now clear that restraining the edges particularly as to capability for bending wave vibration has beneficial effects for acoustic coupling to air, particularly increased efficiency thereof below coincidence frequency. This is, of course, happening within the self-evident context of acoustic output power necessarily being related in a nett manner to losses in the resonant panel member and in the acoustic near field, at least the latter clearly being reduced by edge restrain thereof effectively eliminating acoustic short-circuiting about such edge(s) subject to such restraint.

It seems reasonable to attribute increased acoustic coupling to air below coincidence with reflection of such energy that would otherwise be lost in the acoustic near field, if only on the basis that such energy is in bending wave vibration of resonant mode frequencies of the panel member within acoustic range of interest and must leave the panel member as acoustic energy, whether as improved coupling to air at restrained edges or medially of the panel member. The situation above coincidence frequency is, of course, unaffected. This is, of course, all within the further context of available resonant modes of panel members with edge restraint being necessarily without twisting modes of vibration that are effectively reduced or eliminated by the edge restraint, preferably clamping.

Further investigations were made regarding location beneficial for a second transducer on a measured effect basis using a relocatable/roving second transducer; and regarding discrete edge restraint/clamping using inertial masses at localised positions. The outcome regarding second transducer locations mainly emphasised the extent and complexity of interaction between effects in a resonant panel member of two transducers. Indeed, best indicated locations for a transducer secondary to a beneficially located first transducer for a resonant panel member of substantially rectangular shape and substantially isotropic bending stiffness were actually at and near to central and at or near to three-quarter length positions along axes bounding the panel quarter in which the first transducer was located, and quality of acoustic output tended to be adversely affected (though no doubt viable for some applications). The outcome for discrete restraint/clamping was particularly interesting in indicating potentially useful transition from close equivalence to continuous restraint/clamping to acoustic frequency pass-filter effects related to greater spacings and relationship(s) to wavelengths of bending waves in the panel member concerned.

What is claimed is:

1. Acoustic device comprising a member affording acoustic operation by reason of beneficial distribution of resonant modes of bending wave vibration therein, the member having physical parameters of geometry, bending stiffness, areal mass distribution and damping which determine the distribution of resonant modes of bending wave vibration therein, the values of said parameters being selected such that the member can operate below as well as above coincidence with said beneficial distribution of resonant modes of bending wave vibration, wherein the member has its acoustically active area at least partly bounded by means having a substantially restraining nature in relation to bending wave vibration of the member, the bounding means being at a peripheral edge of the member and being peripherally continuous over at least 25% of said edge so as to increase reflection of bending wave energy at the restrained edge of the member.

2. Active acoustic device comprising a member affording acoustic operation by reason of beneficial distribution of resonant modes of bending wave vibration therein and beneficial location of at least one bending wave transducer coupled to the member, the member having physical parameters of geometry, bending stiffness, areal mass distribution and damping which determine the distribution of resonant modes of bending wave vibration therein, the values of said parameters being selected such that the member can operate below as well as above coincidence with said beneficial distribution of resonant modes of bending wave vibration, wherein the member has its acoustically active area at least partly bounded by means having a substantially restraining nature in relation to bending wave vibration of the member, the bounding means being at a peripheral edge of the member and being peripherally continuous over at least 25% of said edge, and the location of said at least one transducer is determined with reference to and taking account of the effect of the bounding means on the distribution of resonant modes of bending wave vibration.

3. Acoustic device according to claim 1 or claim 2, wherein the bounding means is for and at least partially definitive of said acoustically active area, the member being or being part of a more extensive structure.

4. Acoustic device according to claim 1 or claim 2, wherein the member is a panel-form member, and substantially the whole area of the member is the acoustically active area.

5. Acoustic device according to claim 1, wherein the bounding means extends along one side of a substantially rectangular acoustically active area of the member.

6. Acoustic device according to claim 5, wherein the bounding means also extends along the opposite parallel side of said area.

7. Acoustic device according to claim 1, wherein the bounding means extends fully about said area.

8. Acoustic device according to claim 1 or claim 2, wherein the bounding means contributes significantly to overall stiffness of the member as effective in desired acoustic operation.

9. Acoustic device according to claim 8, wherein bending stiffness of the member in said acoustically active area is below about 5 Newtonmeters.

10. Acoustic device according to claim 9, wherein said bending stiffness is above about 0.001 Newtonmeter.

11. Acoustic device according to claim 8, wherein surface density of the member in said acoustically active area is at least about 25 gram/square meter.

12. Acoustic device according to claim 1 or claim 2, wherein said area of said member has isotropic bending stiffness.

13. Acoustic device according to claim 1 or claim 2, wherein said area of said member has bidirectional anisotropy of bending stiffness.

14. Acoustic device according to claim 1 or claim 2, wherein said area of said member has distribution of bending stiffness suiting desired beneficial location for at least one transducer.

15. Acoustic device according to claim 1 or claim 2, wherein said area is substantially rectangular with isotropy of bending stiffness thereof, and has an aspect ratio between 1:1 and 1:1.5.

16. Acoustic device according to claim 1 or claim 2, wherein said area is substantially rectangular with isotropy of bending stiffness thereof, and has an aspect ratio greater than 1.5:1.

17. Acoustic device according to claim 16, wherein said aspect ratio is about 3:1 or more.

18. Acoustic device according to claim 1 or claim 2, wherein the bounding means serves to at least limit resonant modes of bending wave action that involve twisting.

19. Acoustic device according to claim 1 or claim 2, wherein the bounding means serves to at least reduce near field cancellation of acoustic output.

20. Acoustic device according to claim 1 or claim 2, wherein the bounding means serves to increase acoustic output from energy of resonant bending wave action in said area.

21. Acoustic device according to claim 1 or claim 2, wherein the member is tensioned.

22. Acoustic device according to claim 21, wherein the member is tensioned in two mutually transverse directions.

23. Acoustic device according to claim 22, wherein the tensioning in the two directions is equal.

24. Acoustic device according to claim 21, wherein the bending stiffness of the member in the acoustically active area is low.

25. Acoustic device according to claim 21, wherein the surface density of the member in the acoustically active area is low.

26. Acoustic device according to claim 1 or claim 2, wherein the bounding means is integral with the member.

27. Acoustic device according to claim 26, wherein the bounding means is moulded integrally with the member.

* * * * *